US011147319B2

(12) United States Patent
Karp et al.

(10) Patent No.: US 11,147,319 B2
(45) Date of Patent: Oct. 19, 2021

(54) INFANT SWADDLE SACK WITH HARNESS

(71) Applicant: HB Innovations, Inc., Los Angeles, CA (US)

(72) Inventors: Harvey Neil Karp, Los Angeles, CA (US); Nina Montée Karp, Los Angeles, CA (US)

(73) Assignee: HB Innovations, Inc., Los Angeles, CA (US)

( * ) Notice: Subject to any disclaimer, the term of this patent is extended or adjusted under 35 U.S.C. 154(b) by 0 days.

(21) Appl. No.: 17/002,325

(22) Filed: Aug. 25, 2020

(65) Prior Publication Data

US 2021/0059319 A1 Mar. 4, 2021

Related U.S. Application Data

(60) Provisional application No. 62/891,789, filed on Aug. 26, 2019.

(51) Int. Cl.
*A47G 9/08* (2006.01)
*A41B 13/06* (2006.01)
(Continued)

(52) U.S. Cl.
CPC ..... *A41B 13/065* (2013.01); *A47D 9/02* (2013.01); *A47D 15/008* (2013.01)

(58) Field of Classification Search
CPC ..... A47G 9/08; A47D 13/08; A47D 15/02; A47D 15/005; A47D 15/008; A41B 13/06; A41B 13/065
See application file for complete search history.

(56) References Cited

U.S. PATENT DOCUMENTS 1,431,570 A * 10/1922 Connor ..... A47D 15/008 128/873
1,919,154 A * 7/1933 Astrove ..... A41B 13/06 2/69

(Continued)

FOREIGN PATENT DOCUMENTS

| | | |
|---|---|---|
| AU | 2012265561 | 7/2014 |
| GB | 2515400 | 6/2016 |
| GB | 2528702 | 4/2018 |

OTHER PUBLICATIONS

International Search Report issued in PCT/US2020/047819, dated Nov. 20, 2020.

*Primary Examiner* — Peter M. Cuomo
*Assistant Examiner* — Ifeolu A Adeboyejo
(74) *Attorney, Agent, or Firm* — Akerman LLP

(57) ABSTRACT

A swaddle garment may include a body having a back side and a front side that together define an interior space for swaddling an infant. The front side may include a first side and a second side that are selectively couplable to enclose the interior space. A harness is attached or attachable within the interior space along the backside of the body of the swaddle garment. The harness includes a back side, a torso wrap, and a diaper flap. The back side positions along a portion of the back side of the body. The torso wrap is configured wrap around a torso of an infant and may include a first side and a second side extendable from the back side of the torso wrap. The diaper flap is configured to wrap around a crotch of the infant and may be extendable from the back side of the harness from an anchor end to a securing end.

20 Claims, 29 Drawing Sheets

(51) Int. Cl.
*A47D 15/00* (2006.01)
*A47D 9/02* (2006.01)

(56) References Cited

U.S. PATENT DOCUMENTS 1,940,224 A * 12/1933 Munro ..... A41B 13/06 2/69.5
2,034,954 A * 3/1936 Murphy ..... A41B 13/065 128/874
2,102,281 A * 12/1937 Pringle ..... A47D 15/008 128/875
2,423,392 A * 7/1947 Krogh ..... A41B 13/065 128/873
2,481,741 A * 9/1949 Graves ..... A47D 15/008 128/873
2,651,781 A * 9/1953 Buchholz ..... A41B 13/06 2/69.5
2,652,052 A * 9/1953 Smith ..... A41B 13/06 128/873
2,693,177 A * 11/1954 Barstow ..... A41B 13/06 128/874
2,863,450 A * 12/1958 Johnson ..... A47D 15/008 128/874
3,093,132 A * 6/1963 Bailey ..... A47D 15/008 128/873
3,536,067 A * 10/1970 Sternagel ..... A47D 15/008 128/873
4,897,885 A * 2/1990 Lunt ..... A41B 13/06 2/69.5
RE34,763 E * 10/1994 Tucker ..... A47D 15/008 128/872
5,400,803 A * 3/1995 Vines ..... A61F 5/3769 128/869
5,494,052 A * 2/1996 Grohman ..... A61F 5/3769 128/873
5,595,192 A * 1/1997 Tatum ..... A61F 5/3769 128/869
5,746,219 A * 5/1998 McConnell ..... A47D 15/008 128/845
6,499,165 B1 * 12/2002 Morgillo ..... A47D 13/08 5/655
7,003,831 B1 * 2/2006 Goutevenier-Reyher ..... A47D 13/08 5/633
7,251,846 B1 * 8/2007 Elkin ..... A47D 13/08 128/875
7,370,377 B2 * 5/2008 Landry ..... A47D 15/02 5/494
D690,426 S * 9/2013 Houston ..... D24/190
8,572,782 B1 * 11/2013 Amini ..... A47G 9/04 5/655
8,782,831 B2 * 7/2014 Houston ..... A41B 13/06 5/494
10,278,514 B1 * 5/2019 Emerson ..... A47D 13/02
2004/0199999 A1 * 10/2004 Landry ..... A47D 15/02 5/494
2007/0061968 A1 * 3/2007 Fader ..... A47D 15/008 5/494
2010/0275373 A1 * 11/2010 Kaplan ..... A41B 13/06 5/494
2010/0275932 A1 * 11/2010 Shackleton ..... A47D 15/008 128/872
2011/0179546 A1 7/2011 Millette
2012/0110716 A1 * 5/2012 Christensen ..... A47G 9/083 2/69.5
2013/0036551 A1 * 2/2013 McGann ..... A61G 7/05 5/621
2013/0139290 A1 * 6/2013 Barski ..... A41B 13/06 2/69.5
2014/0020177 A1 * 1/2014 Coates ..... A41B 13/06 5/494
2014/0373275 A1 * 12/2014 Buckson ..... A61F 5/3723 5/494
2015/0045608 A1 * 2/2015 Karp ..... A47D 9/02 600/28
2015/0128350 A1 * 5/2015 Paperno ..... A41B 13/065 5/655
2015/0182043 A1 * 7/2015 Vickerman ..... A61F 5/3784 5/494
2016/0037827 A1 * 2/2016 Rogers ..... A47D 13/02 5/655
2016/0174728 A1 * 6/2016 Karp ..... A41B 13/06 5/655
2016/0174731 A1 * 6/2016 Pulley ..... A47D 15/005 128/878
2017/0049158 A1 * 2/2017 Zeidman ..... A41B 13/06
2017/0055591 A1 * 3/2017 Clouse ..... A47D 15/008
2017/0245555 A1 8/2017 Karp
2018/0007976 A1 * 1/2018 Lager ..... A47D 15/008
2019/0335920 A1 * 11/2019 Herrera ..... A47D 15/008
2020/0196685 A1 * 6/2020 Williams ..... A47G 9/04
2020/0375372 A1 * 12/2020 Sullivan ..... A47G 9/0238

* cited by examiner

INFANT SWADDLE SACK WITH HARNESS

CROSS-REFERENCE TO RELATED APPLICATIONS

This application claims priority benefit to U.S. Provisional Application No. 62/891,789, filed Aug. 26, 2019, which is incorporated herein by reference.

TECHNOLOGY FIELD

The present disclosure relates to infant garments, and specifically to swaddling garments with enclosable interiors for swaddling an infant.

BACKGROUND

Persistent crying and poor infant sleep are perennial and ubiquitous causes of parent frustration. During the first months of life, babies fuss/cry an average of about two hours/day and wake two to three times a night. One in six infants is brought to a medical professional for evaluation for sleep/cry issues.

Infant crying and parental exhaustion are often demoralizing and directly linked to marital conflict, anger towards the baby, impaired job performance, and are primary triggers for a cascade of serious/fatal health sequelae, including postpartum depression (which affects about 15% of all mothers and 25-50% of their partners), breastfeeding failure, child abuse and neglect, infanticide, suicide, unsafe sleeping practices, SIDS/suffocation, cigarette smoking, excessive doctor visits, overtreatment of infants with medication, automobile accidents, dysfunctional bonding, and perhaps maternal and infant obesity. Thus, there is a need for improved infant calming and infant sleep aids to promote relaxation and sleep (by reducing sleep latency and increasing sleep efficiency). "Sleep latency" may be defined as the length of time between going to bed and falling asleep. "Sleep efficiency" may be defined as the ratio of time spent asleep (total sleep time) to the amount of time spent in bed.

SUMMARY

In one aspect, a swaddle garment includes a body having a back side and a front side that together define an interior space for swaddling an infant. The front side may include a first side and a second side that are selectively couplable to enclose the interior space. The swaddle garment may also include a harness that is attached or attachable within the interior space along the backside of the body of the swaddle garment. The harness may include a back side, a torso wrap, and a diaper flap. The back side may be positioned along a portion of the back side of the body. The torso wrap is configured wrap around a torso of an infant and may include a first side and a second side extendable from the back side of the torso wrap. The diaper flap is configured to wrap around a crotch of the infant and may be extendable from the back side of the harness from an anchor end to a securing end.

In one embodiment, the first side and second side are extendable around the torso and arms of the infant to secure arms of the infant at sides of the infant.

In an above or another embodiment, the first side of the torso wrap may include an attachment structure and the second side of the torso wrap may include an attachment structure. The attachment structures of the first and second sides of the torso wrap may be selectably couplable.

In an above or another embodiment, the securing end of the diaper flap may extend a horizontal width wider than a midsection of the diaper flap.

In an above or another embodiment, the anchor end and the securing end may have horizontal lengths greater that a horizontal length of a midsection of the diaper flap.

In an above or another embodiment, the diaper flap may include an adjustable operable length to accommodate multiple crotch lengths. In one example, one or both of the first side or second side of the torso wrap includes an attachment structure having multiple attachment points along a vertically extending length for selectively coupling to the diaper flap to adjust the operable length of the diaper flap.

In an above or another embodiment, upper surfaces of both the first side and second side of the torso wrap include attachment structures for coupling to an attachment structure at the securing end of the diaper flap.

In an above or another embodiment, when the diaper flap is secured to the torso wrap, the securing end of the diaper flap attaches to both the first side and the second side of the torso wrap.

In an above or another embodiment, an attachment structure along an underside of the first side of the torso wrap couples to a corresponding attachment structure along an upper side of the second side of the torso wrap. An attachment structure along an underside of the securing end of the diaper flap may couple to attachment structures along upper sides of the coupled first side and second side of the torso wrap. In a further example, the attachment structures along the undersides of the first side of the torso wrap and the securing end couple to the attachment structure along the upper side of the second side of the torso wrap.

In an above or another embodiment, the torso wrap includes an adjustable girth.

In an above or another embodiment, the back side of the body of the swaddle garment includes the back side of the harness.

In an above or another embodiment, the back side of the harness is removably attachable to the back side of the body of the swaddle garment via hook and loop, snaps, or clips.

In an above or another embodiment, the first side of the torso wrap, second side of the torso wrap, diaper flap, or combination thereof directly attach to the back side of the body of the swaddle garment, and wherein the back side of the body of the swaddle garment includes the back side of the harness.

In an above or another embodiment, the swaddle garment further includes an attachment mechanism for selectively attaching the swaddle garment to a movable platform of a sleep device. In a further example, the swaddle garment includes a support element for elevating legs of the infant, a torso weight, or both.

In another aspect, a sleep system includes a sleep device and a swaddle garment. The sleep device may include a movable platform and an attachment mechanism. The swaddle garment may include a body having a back side and a front side that together define an interior space for swaddling an infant. The front side may include a first side and a second side that are selectively couplable to enclose the interior space. The swaddle garment may also include a harness that is attached or attachable within the interior space along the backside of the body of the swaddle garment. The harness may include a back side, a torso wrap, and a diaper flap. The back side may be positioned along a portion of the back side of the body. The torso wrap is configured wrap around a torso of an infant and may include a first side and a second side extendable from the back side of the torso wrap. The diaper flap is configured to wrap around a crotch of the infant and may be extendable from the back side of the harness from an anchor end to a securing end. The sleep garment may also include an attachment mechanism for selectively coupling to the attachment mechanism of the sleep device to secure and release the swaddle garment with respect to the movable platform.

In one embodiment, the sleep garment includes a support element for elevating legs of the infant, a torso weight, or both.

In one embodiment, the system further includes an enclosure for enclosing the swaddle garment within an interior space of the enclosure. The enclosure may include a support element for elevating legs of the infant, a torso weight, or both.

BRIEF DESCRIPTION OF THE DRAWINGS

The novel features of the described embodiments are set forth with particularity in the appended claims. The described embodiments, however, both as to organization and manner of operation, may be best understood by reference to the following description, taken in conjunction with the accompanying drawings in which:

FIGS. 3A-3F illustrate various views of an infant swaddle garment including attachment wings according to various embodiments described herein, wherein FIG. 3A is a front side view, FIG. 3B is a back side view, FIG. 3C is a right side view, FIG. 3D is a left side view, FIG. 3E is an isolated back side view of an attachment mechanism, and FIG. 3F is an isolated front side view of an attachment mechanism;

FIGS. 6A-6C illustrate an interior harness for a swaddle garment according to various embodiments described herein, wherein FIG. 6A is a front side view with the harness in an unfolded configuration, FIG. 6B is a back side view with the harness in an unfolded position, and FIG. 6C is a front side view with the harness folded into a securing position;

FIGS. 8A-8E illustrate an infant swaddle garment including an interior harness, wherein FIG. 8A illustrates the harness unfolded, FIG. 8B illustrates the harness folded into a securing position, FIG. 8C illustrates the harness with a first side folded over, FIG. 8D illustrates the harness with a second side folded over, and FIG. 8E provides an isolated view of the diaper flap according to various embodiments described herein;

DETAILED DESCRIPTION

Figure 1:
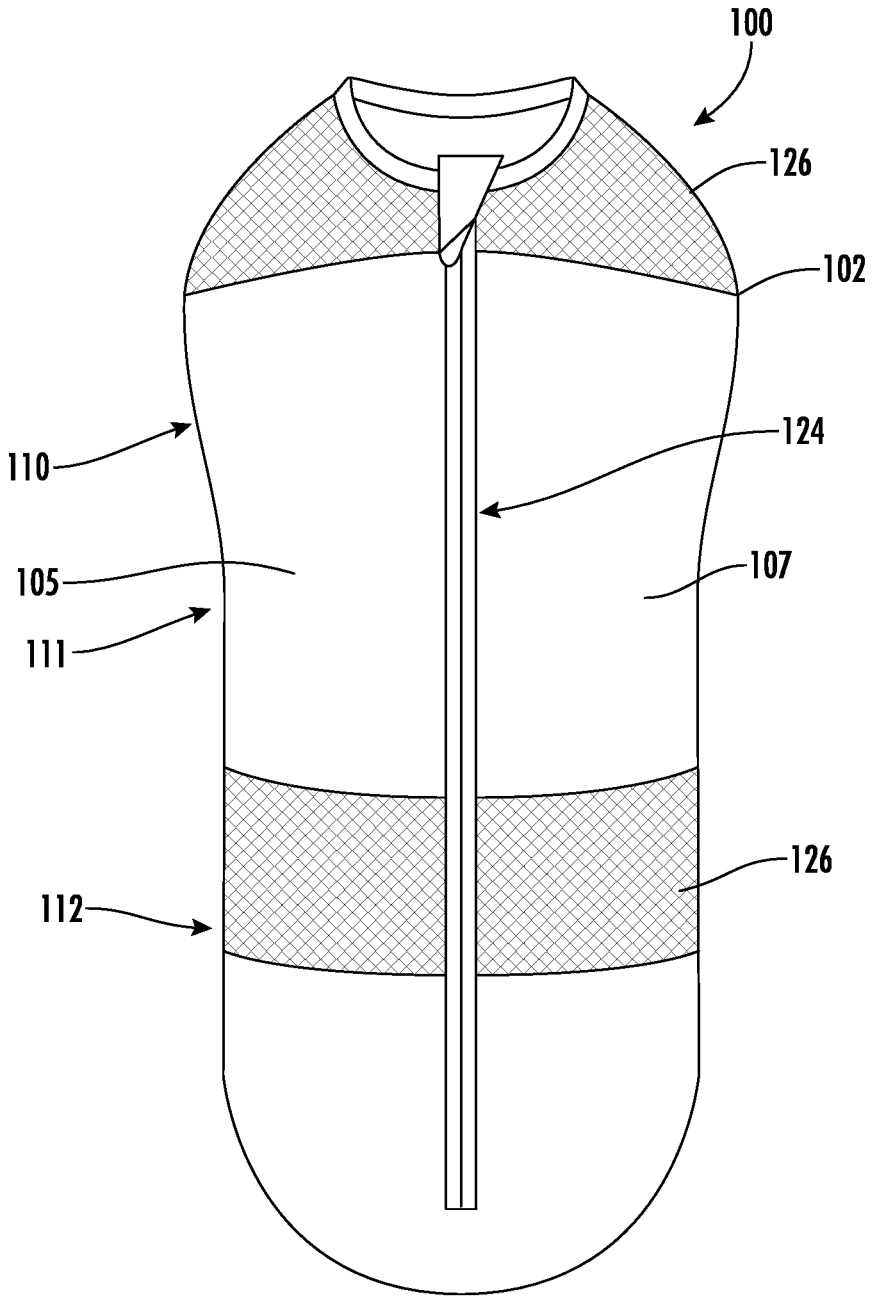
FIG. 1 illustrates a front side view of a swaddle garment according to various embodiments described herein.

Traditional parenting practices have utilized swaddling, rhythmic motion and certain sounds to soothe fussing infants and promote sleep by reducing sleep latency and increasing sleep efficiency. Swaddling, rhythmic motion and certain positions and sounds may be utilized to imitate elements of in utero sensory milieu and activate a suite of subcortical reflexes, called the "calming reflex." during the first 4-6 months of a baby's life.

Swaddling, for example, is a method of snug wrapping of the infant with the arms restrained. Arms may be restrained upward, outward, or with one or more arms folded across the chest of torso of the infant. This imitates the confinement and continual touch a baby experienced in the womb. Swaddling also inhibits startling and flailing, which often interrupts sleep and starts/exacerbates crying. According to the swaddling apparatuses and techniques described herein, best results are believed to be achieved by restraining arms at the sides of the infant.

In addition, SUID (Sudden Unexplained Infant Death) is a leading cause of infant mortality. Approximately 3700 US babies die each year from SUID during the first year of life. The peak occurrence is from 2-4 months of age, with 80% of the victims being under 4 months and 90% being under 6 months of age.

In the 1990's, a program to reduce SUID deaths called "Back to Sleep" was introduced. At that time, it was discovered that sleeping on the stomach was a key triggering factor in many of the deaths, so caregivers were instructed to place babies on their backs for sleeping. Within less than a decade, the rate of SUID dropped almost in half, however, since 1999, the SUID incidence has barely diminished. Studies have indicated that stomach sleeping may indeed predispose babies to SUID by causing suffocation or by reducing infant arousability and inhibiting breathing.

In addition, many babies fall from sleeping areas during the first 6 months of life. Federal reports reveal that 69% of recent bassinet/cradle incidents have been attributed to falling. All falls resulted in head injury. Alarmingly, 45% of falls occurred in infants five months old or less.

Therefore, a need exists for an infant garment that constrains the movement of the infant while promoting the calming reflex of the infant.

In various embodiments, an infant swaddle garment of the present disclosure comprises a body having a first side, and a second side opposite the first side. The first side and the second side may meet along a back portion or side of the body or otherwise may extend from lateral sides of a back side of the body. The first, second, and back sides may together define an interior space therebetween to receive an infant. The body may include an opening that may be selectively opened and closed by respectively decoupling and coupling the first side and the second side. When the first and second sides are decoupled, the opening may be revealed to allow an infant to be positioned within the interior space. With the infant positioned within the interior space, the first side may be coupled to the second side to close the opening such that the infant is enveloped by the sides.

In some embodiments, the swaddle garment further includes a harness for harnessing the infant with respect to the swaddle garment. The harness may be configured to harness the infant within the interior space of the swaddle garment. In one example, the harness is attached or attachable to the body of the swaddle garment, typically to one or more sides within the interior space of the swaddle garment.

The harness may include a torso wrap for securing the infant with respect to the body of the swaddle garment. The torso wrap may include a material positioned within the interior of the body to wrap around the torso of the infant. The harness may also include an arm wrap for restraining arms of an infant. The arm wrap may be separate or integrated with the torso wrap. For example, sleeves for receiving arms, wrists, hands, or combination thereof may be positioned on an interior or exterior side of the torso wrap. In some embodiments, a torso wrap having an integrated arm wrap may be positioned or be positionable along the interior portions of one or more sides of the body, within the interior space, and be dimensioned to extend around both the torso and arms of the infant to secure the arms of the infant to the sides of the infant while also securing the position of the infant with respect to the body by wrapping around the torso of the infant. Wrap material may extend from the back side of the body or lateral portions thereof, which in some examples may include first and second sides. The torso wrap may be positioned to extend around a waist, hips, and/or stomach of the infant.

In various embodiments, the harness includes a diaper flap for wrapping around a crotch of an infant. The diaper flap may cooperate with the torso wrap to secure the position of the infant with respect to the swaddle garment. In some configurations, the diaper flap is removably couplable to the torso wrap. In one configuration, the diaper flap may include lateral strips that secure to the back side of the swaddle garment or that couple to a belt that may be attached or attachable to the back side of the swaddle garment.

In some embodiments, a swaddle garment includes one or more accommodation mechanisms that may elevate a lower body portion of an infant. Further examples of accommodation mechanisms may include weights configured for placement over a torso of an infant. In one example, a swaddle garment includes one or more accommodation mechanisms in addition to a harness. In further examples, a swaddle system may include a swaddle garment including a harness and an enclosure for receiving the swaddle garment. In yet a further example, the enclosure includes one or more accommodation mechanisms.

FIGS. 1-9D illustrate various embodiments of a swaddle garment, swaddle garment features, swaddle garment accessories wherein like features are identified by like numerals. FIGS. 10-21 illustrate further swaddle garment accessories and swaddle systems comprising enclosures for swaddle garments.

Figure 2:
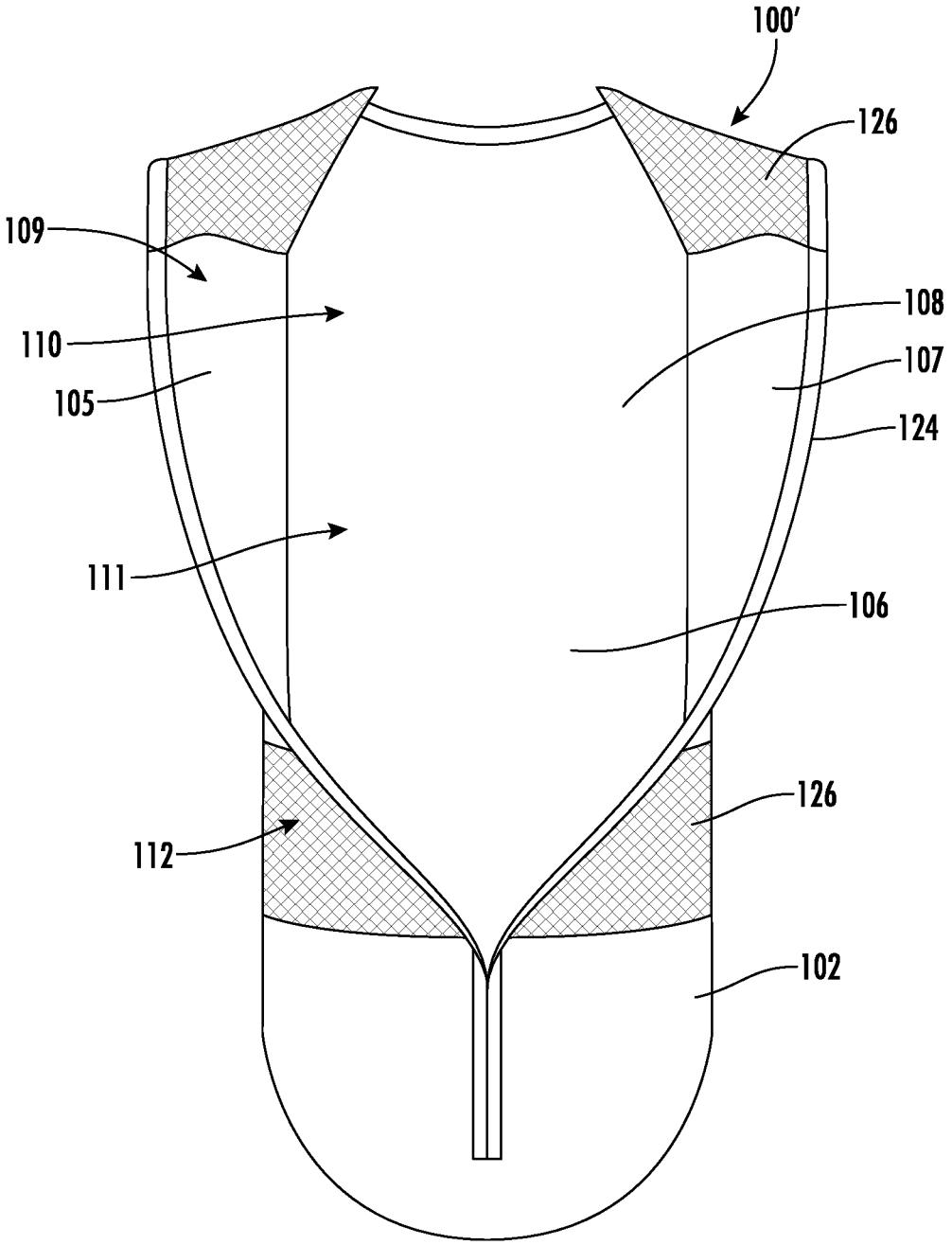
FIG. 2 illustrates an infant swaddle garment opened to reveal an interior space for swaddling an infant according to various embodiments described herein.

FIGS. 1 & 2 illustrate an infant swaddle garment 100 according to various embodiments. The swaddle garment 100, which may also be referred to herein as a sleep sack, may be configured as a clothing article or an over garment to be worn by an infant. The swaddle garment 100 includes a body 102 having a front side 104 and a back side 106. The front and back sides 104, 106 define an interior space 108 therebetween to swaddle an infant, wherein the front side 104 corresponds to a front of the body 102 and the back side corresponds to a back of the body 102. The front side 104 also includes a first side 105 and a second side 107 that define a selectively closable opening 109. The selectively closable opening 109 provides an opening into the interior space 108. The body 102 may include an attachment device 124 configured to open and close the opening 109 for receiving, enclosing, and removing the infant with respect to the interior space 108 of the body 102. For example, the first side 105 and second side 107 may include attachment structures configured to cooperate to couple to close the opening 109 and decouple to open the opening 109. FIG. 2 illustrates the swaddle garment 100 of FIG. 1 with the attachment device 124 decoupled such that the opening 109 is open. The attachment structures may include zipper halves, buttons and openings or loops, hook and loop, snaps, clips, magnets, snap fit, compression fit, or other attachment structures configured to removably couple and/or mate. In the illustrated embodiment, the attachment device 124 comprises mateable zipper halves on the first and second sides 105, 107 that extend along the perimeter of the opening 109. In other embodiments, the opening 109 and corresponding attachment device 124 may be provided at the back side 106 or one or both lateral side of the back side 106 of the body 102.

The interior space 108 defined by the sides of the body 102 is dimensioned to accommodate an infant and comprises a first portion 110 dimensioned to accommodate an upper body of the infant, and second portion 111 dimensioned to accommodate a mid-region of the infant corresponding to a waist and hips, and a third portion 112 dimensioned to accommodate a lower body region of the infant corresponding to legs and feet. The first portion 110 may have a width or circumference corresponding to a width or circumference of an upper body of an infant. The second portion 111 may have a width or circumference corresponding to a width or circumference of a waist and hips of an infant. The third portion 112 may have a width or circumference corresponding to a width or circumference of lower legs and feet of an infant. In some embodiment, the first, second, or third portions may include widths or circumferences less than or approximately that of average corresponding widths or circumferences of infants. In one embodiment, the first, second, or third portions 110, 111, 112 may include widths or circumferences greater or approximately that of average corresponding widths or circumferences of infants.

In various embodiments, one or more of the first, second, or third portions 110, 111, 112 may comprise an expandable or elastic material that may retract or expand to accommodate at least a portion of the lower body of the infant, or may be adjustable such that a user may set an appropriate dimension of the first portion 110 to accommodate the lower body of the infant. In some embodiments, one or more sides defining the first, second, or third portion 110, 111, 112 do not include elastic properties.

In some embodiments, the body 102 includes breathable fabric. The breathable fabric may extend along the first side 105, second side 107, back side 106, or combination thereof. For example, the body 102 of the embodiment illustrated in FIGS. 1 & 2 includes a mesh fabric 126 for allowing air to move therethrough, such as between the interior space 108 an exterior of the body 102. In some embodiments, the body 102 of a swaddle garment described herein may comprise a sleep sack as described in U.S. patent application Ser. No. 15/055,077, filed Feb. 26, 2016, titled *Infant Calming/Sleep-Aid and SIDS Prevention Device with Drive System*, or U.S. patent application Ser. No. 15/336,519, filed Oct. 27, 2016, titled *Infant Calm/Sleep-Aid, SIDS Prevention Device, and Method of Use*. The disclosures of both of which are hereby incorporated herein by reference.

Figure 4:
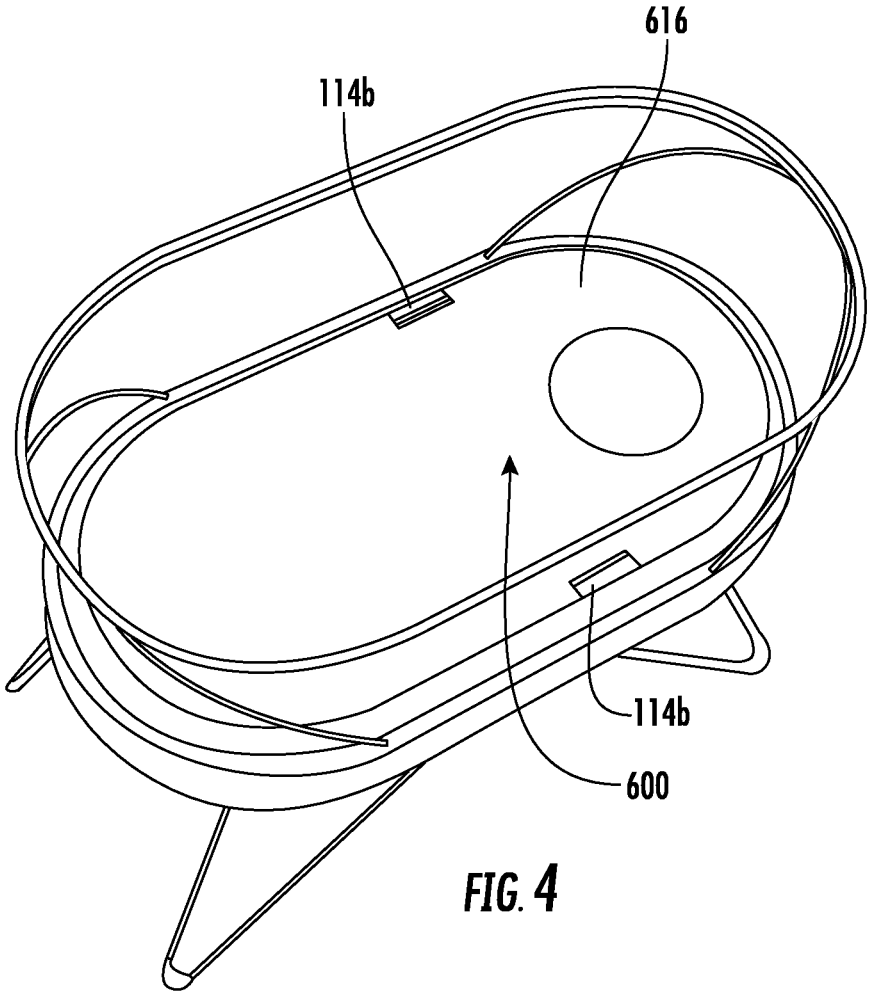
FIG. 4 illustrates a sleep device having a sleep surface according to various embodiments described herein.
Figure 5:
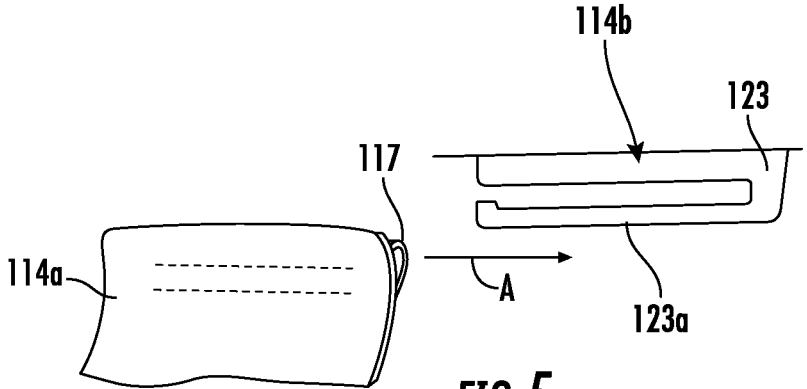
FIG. 5 illustrates an attachment mechanism for securing an infant swaddle garment to a sleep surface according to various embodiments described herein.

FIGS. 3A-3F illustrate a further embodiment of a swaddle garment 100 including an attachment structure 114*a*. The attachment structure 114*a* is configured to couple to a corresponding attachment structure 114*b* (see, e.g., FIG. 4) associated with a location at which the swaddle garment 100 is to be secured. For example, as exemplified in FIG. 4, the corresponding attachment structure 114*b* may be associated with a sleep surface 616 of a bassinet 600. FIG. 5 illustrates an example of an attachment mechanism 114 comprising couplable attachment structures 114*a*, 114*b* for fixing a location of the swaddle garment 100.

With continued reference to FIGS. 3A-5, the attachment structure 114*a* is connected or connectable to the body 102 and is configured to fix the swaddle garment 100 relative to a sleep surface 616. The attachment structure 114*a* may comprise any mechanism configured to secure the swaddle garment 100 to the sleep surface 616 or at another location, such as to prevent an infant inside the swaddle garment 100 from rolling over or otherwise moving into an unsafe disposition. The corresponding attachment structure 114*a* may be configured to couple, e.g., mate or attach, with attachment structure 114*a*. The attachment structures 114*a*, 114*b* may include but are not limited to a clip and a strap configured to attach to the clip, a strap including a clip configured to couple to another strap or clip , a hook and loop attachment mechanism, a compression fit attachment mechanism, a snap attachment mechanism comprising one or more snaps, a zipper mechanism comprising two or more zipper halves, a magnetic attachment mechanism comprising one or more first magnets and one or more second magnets or ferromagnetic materials, or any similar mechanisms configured to secure swaddle garment 100 at desired location, such as to a sleep surface 616. In some embodiments, a strap comprises a stretchable elastic material. In the illustrated embodiment, the attachment structure 114*a* includes two attachment regions, each extending from a lateral side of the swaddle garment 100. However, in other embodiments, the attachment structure 114*a* may include one or more than two attachment regions.

Figure 3A:
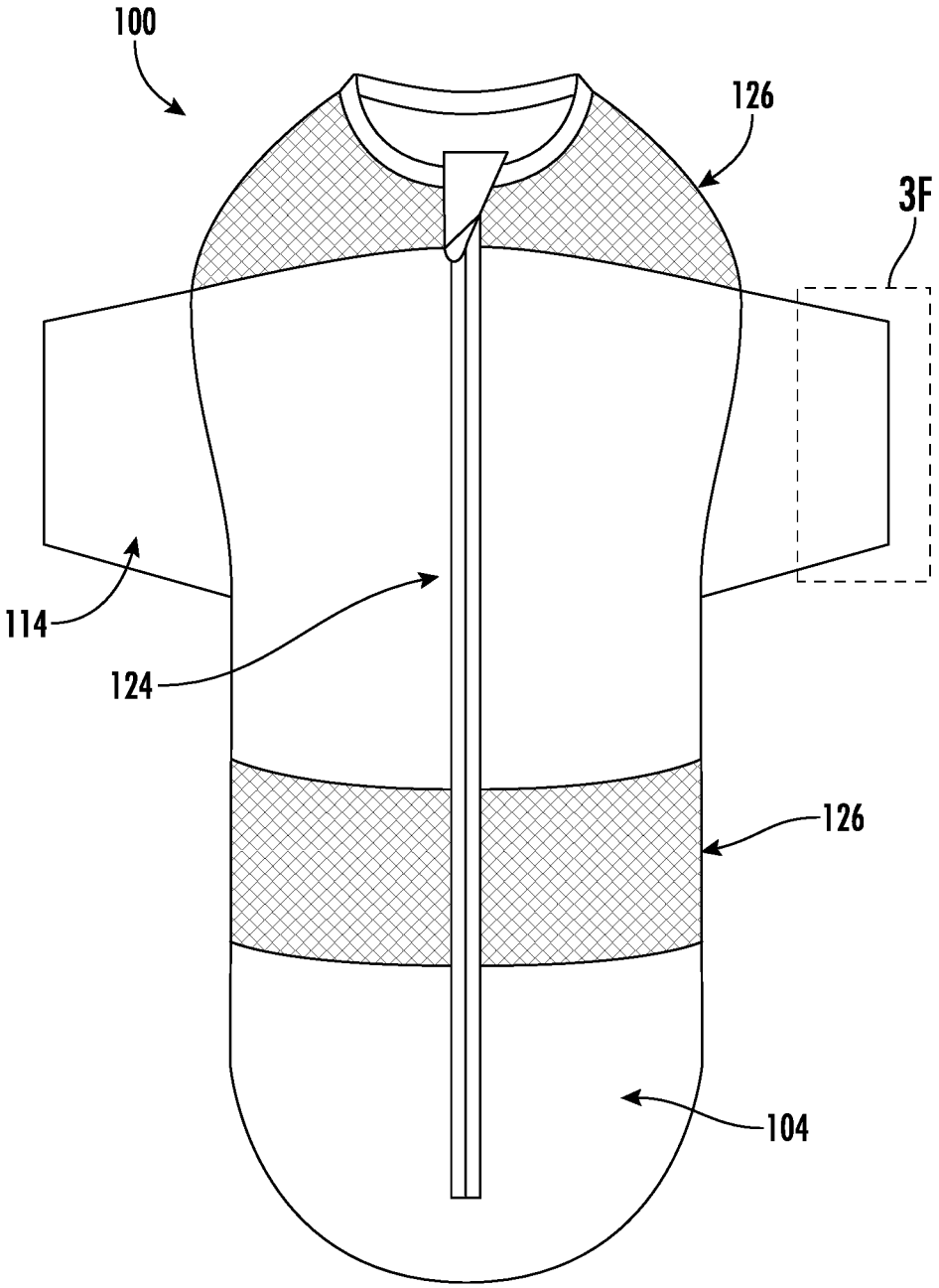
Figure 3B:
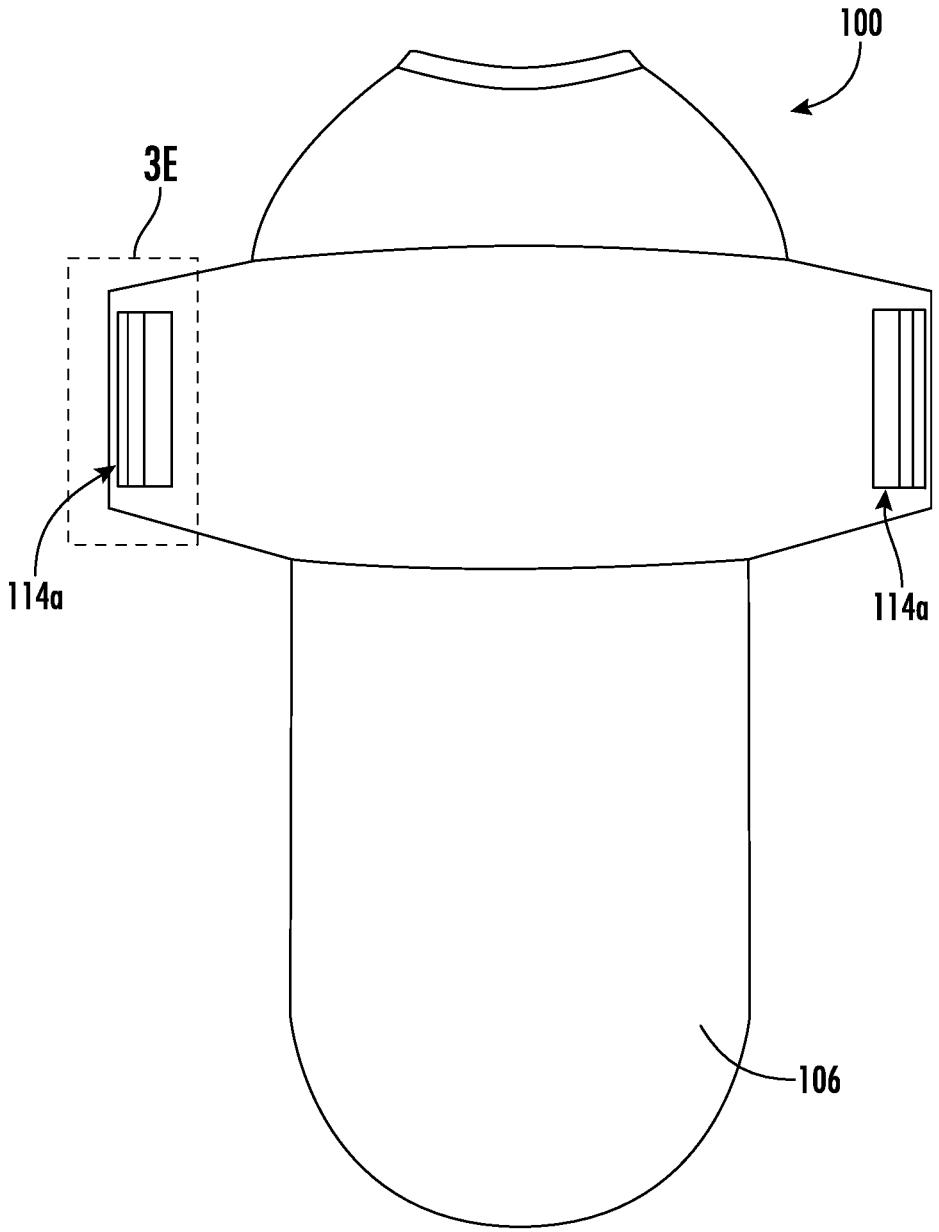
Figure 3C:
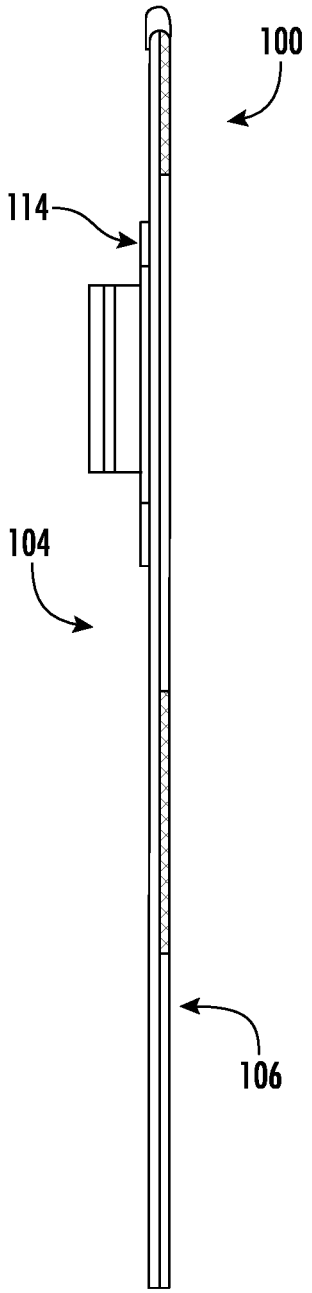
Figure 3D:
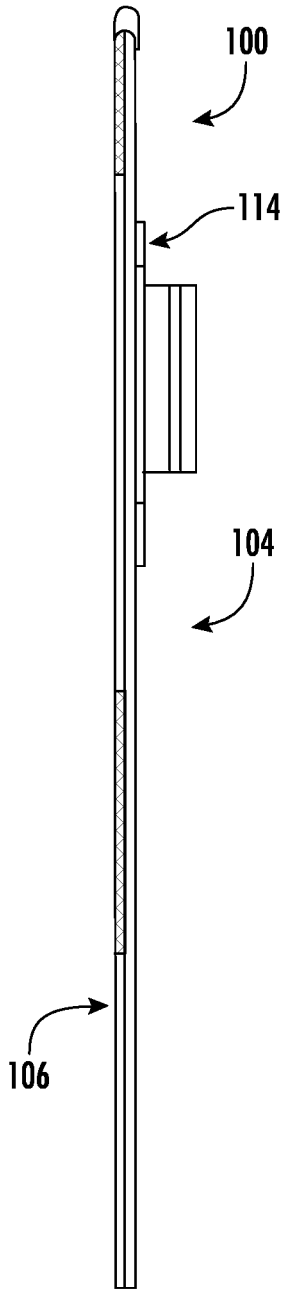
Figure 3E:
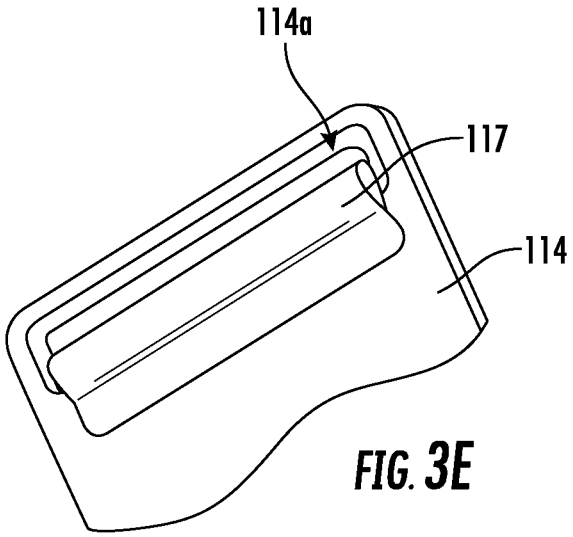
Figure 3F:
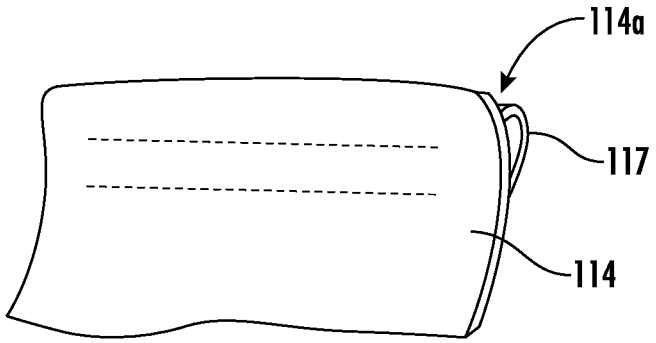

FIGS. 3E & 3F illustrate isolated, enlarged views of lower and upper side views, respectively, of the exemplary attachment structure 114*a*. The attachment structure 114*a* includes loops or sleeves 117 for receiving a corresponding portion of the attachment mechanism 114 comprising a post. FIG. 4 illustrates an example bassinet 121 including a sleep surface 616 and having an attachment structure 114*b* for securing the swaddle garment 100. The attachment structure 114*b* includes one or more clips 123 including a clip arm 123*a* dimensioned to be received within a sleeve 117 of attachment structure 114*a*. This operation is illustrated in the isolated view of the attachment mechanism shown in FIG. 5. The sleeve 117 is shown aligned with clip 123 prior to insertion of the clip arm 123*a* through the sleeve 117. The sleeve 117 may be moved in the direction indicated by arrow A to receive the clip arm 123*a* and thereby couple the attachment structures 114*a*, 114*b*. In another embodiment, the attachment mechanism 114 may include one or more clips for connecting to one or more corresponding sleeves associated with the sleep surface 616 for securing the swaddle garment 100 to the sleep surface 616. In various embodiments, the attachment mechanism 114 may correspond to an attachment mechanism described in U.S. patent application Ser. No. 15/336,519, filed Oct. 27, 2016, titled Infant Calm/Sleep-Aid, SIDS Prevention Device, and Method of Use. In an above or another embodiment, the sleep surface 616 may correspond to a sleep device or bassinet having a movable platform as described in U.S. patent application Ser. No. 15/336,519, filed Oct. 27, 2016, titled Infant Calm/Sleep-Aid, SIDS Prevention Device, and Method of Use. In one embodiment, the swaddle garment 100 includes an attachment structure 114*a* configured to attach to another garment. In one embodiment, the swaddle garment 100 may be accommodated within another garment configured for attachment to sleep surface 616, e.g., via an attachment mechanism associated with the other garment, thereby indirectly securing the swaddle garment 100 to sleep surface 616. In one embodiment, the swaddle garment 100 may be accommodated within another garment wherein the other garment includes one or more openings through which the attachment structure 114*a* may extend outwardly of the garment to secure to a corresponding attachment structure 114*b*.

Figure 6A:
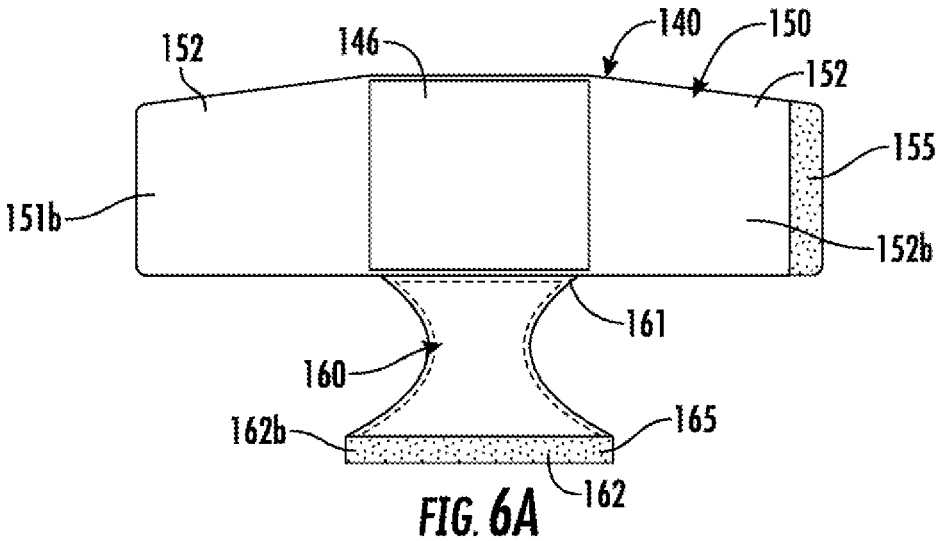
Figure 6B:
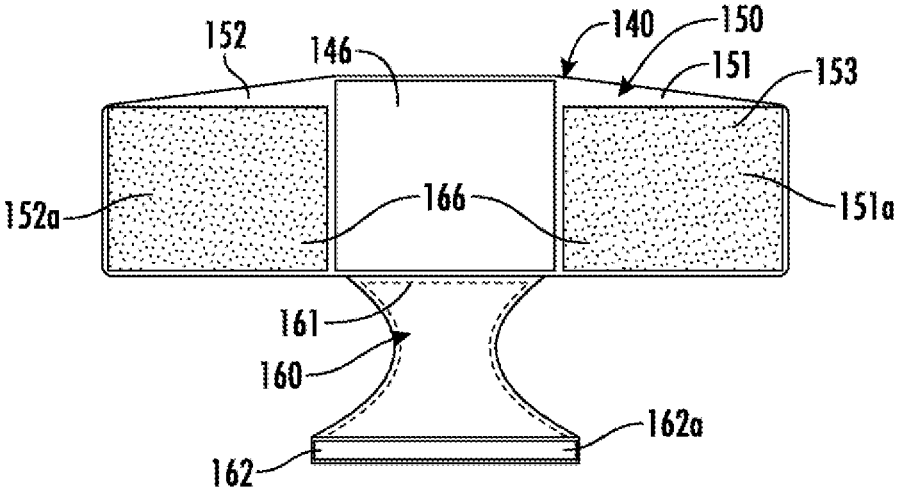
Figure 6C:
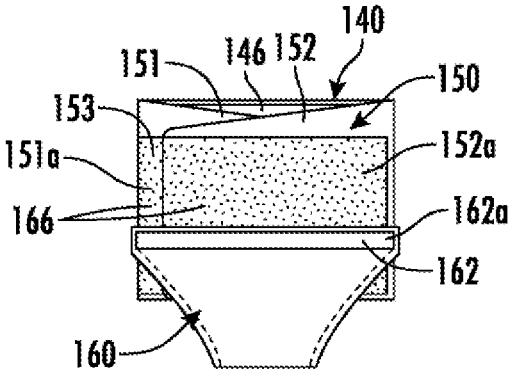

FIGS. 6A-6C illustrate a harness 140 according to various embodiments. The harness 140 includes a torso wrap 150 for wrapping around a torso of an infant and a diaper flap 160 for wrapping around a crotch of the infant. FIG. 6A illustrates a front view, FIG. 6B illustrates a rear view, and FIG. 6C illustrates the harness 140 in a folded position.

The torso wrap 150 includes a first side 151 and a second side 152 configured to together wrap around a torso of an infant. The first side 151 and second side 152 are preferably dimensioned to further wrap around arms of the infant to secure the arms to sides of the infant, which may be optional. The first side 151 and second side 152 of the torso wrap 150 may each be extend around a side of the torso of the infant and thereafter removably couple to securely wrap around the torso of the infant. In a further example, the first side 151 may be extended over an arm and side of a torso of the infant, such as a right arm and right portion of the torso. The second side 152 may be extended over the other arm and other side of the torso, such as a left arm and left portion of the torso and then be removably coupled to the first side 151 to secure the arms and torso of the infant. While the arms are preferably secured to the sides of the infant, in some situations the arms may be folded over the chest of the infant by a caregiver to secure the same. The torso wrap 150 may be dimensioned such that a lower extent of its vertical length along the first side 151 and/or second side 152 extends below wrists of the infant. In some embodiments, the torso wrap 150 may be dimensioned such that an upper extent 1511 of its vertical length along the first side 151 and/or second side 152 extends above elbows of the infant, but below shoulders of the infant. In one embodiment, the torso wrap 150 is dimensioned such that the lower extent 1512 of its vertical length along the first side 151 and/or second side 152 extends below wrists of the infant and the upper extent 1151 of its vertical length along the first side 151 and/or second side 152 extends above elbows of the infant, but below shoulders of the infant. The torso wrap 150 may be configured such that the torso wrap 150 extends around the waist and hips of the infant while also securing arms to the side of the infant. The torso wrap 150 may extend over a stomach including a navel. In some embodiments, the torso wrap 150 extends beyond the wrists of the infant when arms are secured at the sides of the infant such that the arm wrap 150 extends around the wrists and at least a portion of the hands of the infant. The first and second sides 151, 152 may taper outwardly along upper edges and extend approximately level along lower edges. In other embodiments, one or more of the upper edges may include greater, less, or no taper. In these or other embodiments, one or more lower edges may include taper.

The torso wrap 150 may include an attachment mechanism 154 for selectively coupling the first side 151 and second side 152. For example, the first and second sides 151, 152 of the torso wrap 150 may comprise an attachment mechanism 154 for selectively coupling and decoupling the first side 151 and the second side 152. The attachment mechanism 154 typically includes a first attachment structure 153 positioned on the first side 151 and a second attachment structure 155 positioned on the second side 152 wherein the first attachment structure 153 and the second attachment structure 155 are configured for selectively coupling and decoupling. In the illustrated example, the attachment mechanism 154 comprises a hook and loop configuration wherein a first attachment structure 153 comprising a loop material is positioned along a surface of an upper side 151*a* of the first side 151 of the torso wrap 150 and a second attachment structure 155 comprising a hook material is positioned along a surface of an underside 152*b* of the second side 152 of the torso wrap 150. Other configurations may be used. For example, the attachment mechanism 154 may comprise a hook and loop configuration wherein a first attachment structure comprises a loop material positioned along a surface of an underside 151*b* of the first side 151 of the torso wrap 150 and a second attachment structure comprising a hook material positioned along a surface of an upper side 152*a* of the second side 152 of the torso wrap 150. When hook and loop configurations are used, carious loop materials may be used. For example, Velcro may be used or loop material may comprise a polyester tricot. In some embodiments, hook and loop materials may be switched from that described above. For example, hook material may be positioned along the first side and loop material may be positioned along the second side. Some embodiments may include other or additional attachment structures in place of or in addition to those indicated above. For example, the attachment mechanism 154 may include corresponding attachment structures comprising snaps, straps, clips, magnets, zippers, mating structures, or other coupling structures.

The torso wrap 150 may comprise an elastic material along the first side 151 and/or second side 152 of the torso wrap 150. In some embodiments, the first side 151 and/or second side 152 of the torso wrap 150 does not include an elastic or stretchable material. In an above or another embodiment, the torso wrap 150 may have an adjustable enclosure girth. For example, the attachment mechanism 154 may provide a plurality of locations along which corresponding attachment structures are positioned for coupling providing different girth dimensions with respect to the torso wrap 150. In the illustrated embodiment, the surface along the upper side 151*a* of the first side 151 includes a horizontally extending length of loop material, which may extend along all or a portion, such as a majority of the horizontal length of the first side 151. The second attachment structure 155 extends a horizontal length shorter than that of the first attachment structure 153, generally only along an outer end. When hook material is used, this design may avoid potential irritation to larger infants due to contacting the hook material that may be exposed when not extended completely over the loop material of the first attachment structure 153. In one embodiment, the second attachment structure 155 extends a greater horizontal length of the second side 152, which may include a majority of the horizontal length of the second side. While other configurations may be used, in the illustrated example, the first attachment structure 153 extends along a majority to approximately all of the vertical length of the first side 151. The second attachment structure 155 extends along approximately all of the vertical length of the outer end of the second side 152. The vertical heights of the attachment structures 153, 155 approximately correspond. In some embodiments, the vertical length of an end of the first and/or second side 151, 152 of the torso wrap may not be configured to couple along its full vertical length. In some embodiments, not shown, the attachment mechanism 154 includes mateable clips wherein one or more of the clips extends from an adjustable length of belt that may be adjusted to adjust the girth enclosed by the torso wrap 150.

With continued reference to FIGS. 6A-6C, the first side 151 and second side 152 laterally extend from a back side 146 of the harness. The back side 146 may be configured to span a width of a back of the infant. Additionally or alternatively, in some embodiments, the first and second sides 151, 152 may attach directly to a back side of a body of a swaddle garment, such as any swaddle garment, enclosure, or sleep sack described herein, in which case the back side 146 of the harness 140 may correspond with the back side of the body. Thus, the first side 151, second side 152 or both may include attachment structures for coupling to the back side of the body. The back side 146 may include a length of material and may be attached by thread, snaps, clips, hook and loop, or other attachment structures or may be formed from a back side of the swaddle garment. The back side 146 may be removably attachable using hook and loop, clips, snaps, zippers, or other attachment structures configured to cooperatively removable attach the back side within the swaddle garment.

In other embodiments, the first side 151 includes at least a portion of the second side 152. For example, when decoupled, the second side 152 extends from the first side 151 such that the first and second sides 151, 152 may be together extended from one side of the torso to another and then removably coupled at the other side, e.g., to one or more attachment structures positioned along a back side 146 of the harness or a back side of the swaddle garment. In these or other embodiments, the torso wrap 150 may include arm sleeves or pockets along the interior or exterior side of the first side 151 or second side 152, which may include both, to restrain arms of an infant. In another example, a separate arm wrap may be used, such as wraps that extend over the first side 151 and second side 152 of the torso wrap 150.

The diaper flap 160 extends between an anchor end 161 and a securing end 162. In the illustrated example, the anchor end 161 is attached to the back side 146 of the harness 140, corresponding to a position just below a lower extent of the torso wrap 150. Additionally or alternatively, in some embodiments, the anchor end 161 may attach directly to a back side of a body of a swaddle garment, such as any swaddle garment, enclosure, or sleep sack described herein, in which case the back side 146 of the harness 140 may correspond with the back side of the body. In some embodiments, the anchor end 161 may include an attachment structure and be removably attachable to the back side 146 of the harness or a body and/or the diaper flap 160 may be separate from the torso wrap 150.

The securing end 162 of the diaper flap 160 is extendable outwardly from the anchor end 161 with respect to the back side 146 of the harness. In other embodiments, the diaper flap 160 may be outwardly extendable from a lower position or a higher position with respect to the back side 146 of the harness. The diaper flap 160 increases and decreases in width between the anchor end 161 and securing end 162. The increased width at the anchor and securing ends 161, 162 may improve support, comfort, and durability of the diaper flap 160 while the decreasing and increasing widths along a midsection of the diaper flap 160 may conform to crotch dimensions to provide support and comfort to the infant. The securing end 162 includes a horizontal width that corresponds to a portion of a waist of an infant. The horizontal width may be dimensioned to extend over at least a front width of a waist of the infant. In a further example, the horizontal width may be dimensioned to extend over a front width and at least a portion of sides of the waist of the infant. In other embodiments, the diaper flap 160 may decrease in width, increase in width, or maintain a consistent width from the anchor end 161 to the securing end 162. Other combinations of increasing and/or decreasing widths may also be used. In one example, the securing end 162 may couple at a single location less than a front width of a waist of an infant and/or at multiple locations corresponding to the waist of the infant. In some embodiments, the width of the securing end 162 is 125%, 150%, 175%, 200%, 225%, 250%, or greater than the smallest width along the midsection. The securing end 162 may secure along its width such that the lateral ends secure at lateral locations vertically aligned with mid or outer thighs of the infant or approximately to the iliac crests of the infant.

The securing end 162 is configured for removably securing the diaper flap 160 after it has been folded over the crotch of an infant. For example, the harness 140 may include an attachment mechanism 164 comprising a first attachment structure 165 positioned at the securing end 162 and a second corresponding attachment structure 166 for selectively coupling and decoupling the securing end 162 over the crotch of the infant. In the illustrated example, the attachment mechanism 164 comprises a hook and loop configuration wherein the first attachment structure 165 comprises a hook material positioned along an underside 162b of the securing end 162 and the second attachment structure 166 comprises a loop material positioned along the upper side 152a of the second side 152 of the torso wrap 150. The hook and loop materials may be sewn to or otherwise attached to the torso wrap 150 and the securing end 162. To provide adjustable sizing and a snug fit, the diaper flap 160 may have an adjustable operable length. For example, different crotch lengths may be accommodated by adjusting the operable length of the diaper flap 160. Adjustment of the operable length may be accomplished by shortening the length of the diaper flap 160, e.g., a length of the diaper flap may be folded over another length or a buckle may be used to reposition the securing end 162 toward the midsection, or change the vertical location the securing end 162 couples. For example, first and/or the second attachment structure 165, 166 may include multiple locations, e.g., 166*a*, 166*b*, 166*c*, to which the attachment mechanism 164 may secure the diaper flap 160. As shown, the second attachment structure 166 includes a vertically extending length of loop material along which the first attachment structure 165 may couple. The illustrated torso wrap 150 also includes an adjustable girth, as described above. To accommodate for the adjustable girth, the second attachment structure 166 may include a horizontally extending length of loop material greater than the horizontal length of the first attachment structure 165 along the upper side 152*a* of the second side 152 of the torso wrap 150 and/or the upper side 151*a* of the first side 151 of the torso wrap 150. In the illustrated example, the second attachment structure 166 also includes horizontally and vertically extending lengths of loop material along the upper side 151*a* of the first side 151 of the torso wrap 150 providing multiple vertical and horizontal coupling locations in which the first attachment structure 165 may couple to the second attachment structure 166 along the first side 151, second side 152, or both the first side 151 and the second side 152. Thus, the second attachment structure 166 may be configured to provide multiple vertical and horizontal coupling locations with respect to the first attachment structure 165. In some embodiments, the first attachment structure 165 may provide a vertically extending length of hook material to provide multiple coupling locations with respect to the second attachment structure 166. In one embodiment, the first anchor structure 165 may not couple to the second attachment structure 166 along its full vertical and/or horizontal length. It will be appreciated, that in some embodiments, the hook and loop materials described herein with respect to particular attachment structures may be interchanged.

In further embodiments, the attachment mechanism 164 may include other attachment structures 165, 166 in place of or instead of hook and loop such as snaps, straps, clips, zippers, or other coupling structures. Such additional or alternative attachment structures may be similarly positioned at different vertical and/or horizontal locations to allow the size fit of the diaper flap 160 to be adjusted. While FIG. 6C illustrates the first attachment structure 165 positioned along the underside 162*b* of the securing end 162 coupling to the second attachment structure 166 positioned along the upper side 152*a* of the second side 152 of the torso wrap 150, in various embodiments, the first attachment structure 165 may couple to the upper side 151*a* of the first side 151 or to a belt attached to the back side 106 or swaddle garment. In a further embodiment, the first attachment structure 165 may be positioned along an upper side 162*a* of the securing end 162 for coupling to a second attachment structure 166 positioned along the underside 151*b*, 152*b* of the first and/or second sides 151, 152 of the torso wrap 150 or to a belt. In one embodiment, the harness 140 may include straps for extending over tops of the shoulders of the infant and selectively coupling and decoupling to the securing end 152 to secure the diaper flap 160 over the crotch of the infant.

Figure 7E:
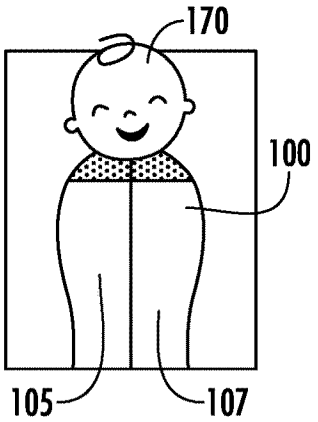
FIGS. 7A-7E illustrate a process of securing an infant within an infant swaddle garment including an interior harness according to various embodiments described herein.
Figure 7D:
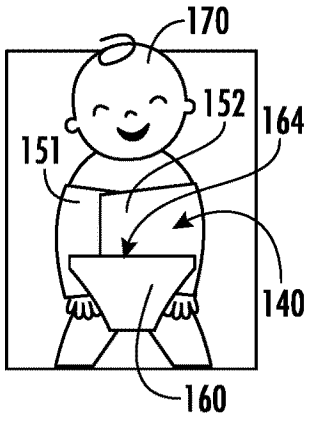
Figure 7C:
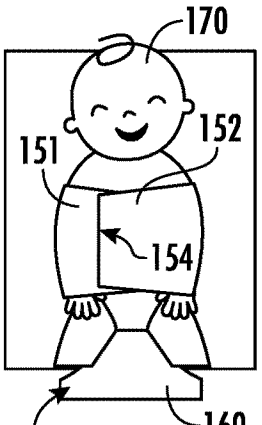
Figure 7B:
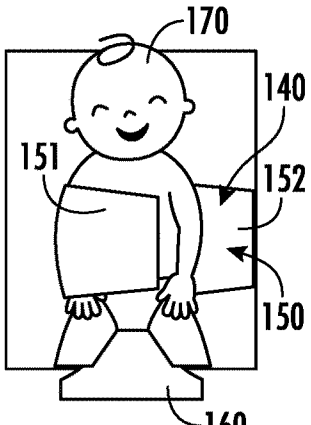
Figure 7A:
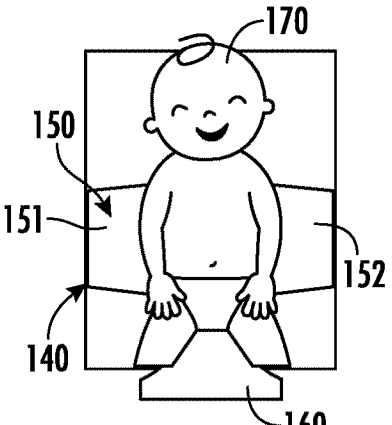

FIGS. 7A-7E illustrate a method of securing an infant 170 in a harness 140 as described above with respect to FIGS. 6A-6C. In FIG. 7A, the infant 170 is positioned on the harness with the back of the infant 170 being positioned over the back side (not visible) of the harness 140. The first and second side 151, 152 of the torso wrap 150 are extended outwardly, beneath the arms of the infant 140. The diaper flap 160 is extended outwardly, between the legs of the infant 170. In FIG. 7B, the first side 151 is extended around the torso, including an arm, of the infant 170. The second side 152 is extended around the torso, including the other arm, of the infant 170 in FIG. 7C and the first and second sides 151, 152 are coupled via an attachment mechanism 154. The attachment mechanism 154 may be configured as described above and elsewhere herein. For example, a first attachment structure comprising a loop material, such as polyester tricot, may be disposed along the first side 151 and may be coupled with a hook material disposed along the second side 152. The first and second sides 151, 152 extend from just below the top of the shoulders of the infant to below the wrists and may cover a portion of the hands. In FIG. 7D, the diaper flap 160 is brought through the legs and secured to the torso wrap 150 via an attachment mechanism 164. The attachment mechanism 164 may be configured as described above and elsewhere herein. For example, a first attachment structure disposed on a securing end of the diaper flap 160 may couple to a second attachment structure disposed on the torso wrap 150. In one configuration, the diaper flap 160 may couple to both the first and second sides 151, 152. For example, the first and second sides 151, 152 may both include the second attachment structure comprising a loop material, such as polyester tricot, disposed along each. The first attachment structure may comprise a hook material disposed along the securing end of the diaper flap for coupling to the loop material. In FIG. 7E, sides 105, 107 of a swaddle garment 100 are coupled to envelope the harnessed infant 170 within an interior space thereof. For example, the harness 140 may be sewn to a back side of swaddle garment 100 or otherwise attached thereto. As noted above, the harness 140 may be attached to or attachable to a swaddle garment 100, which may include a sleep sack or enclosure. As introduced above, a swaddle garment may include a harness. The harness may be attached or attachable with respect to the swaddle garment.

Figure 8A:
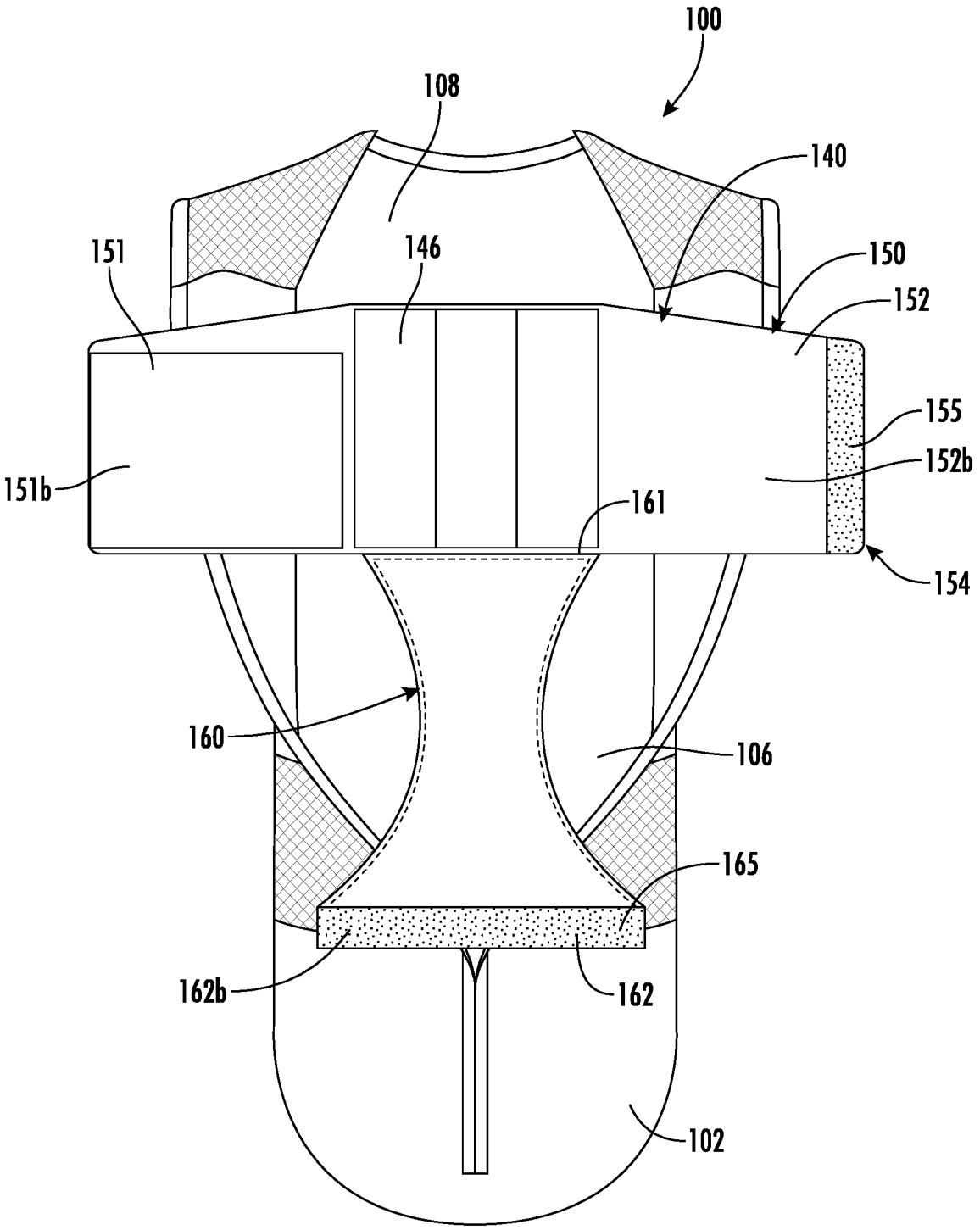
Figure 8B:
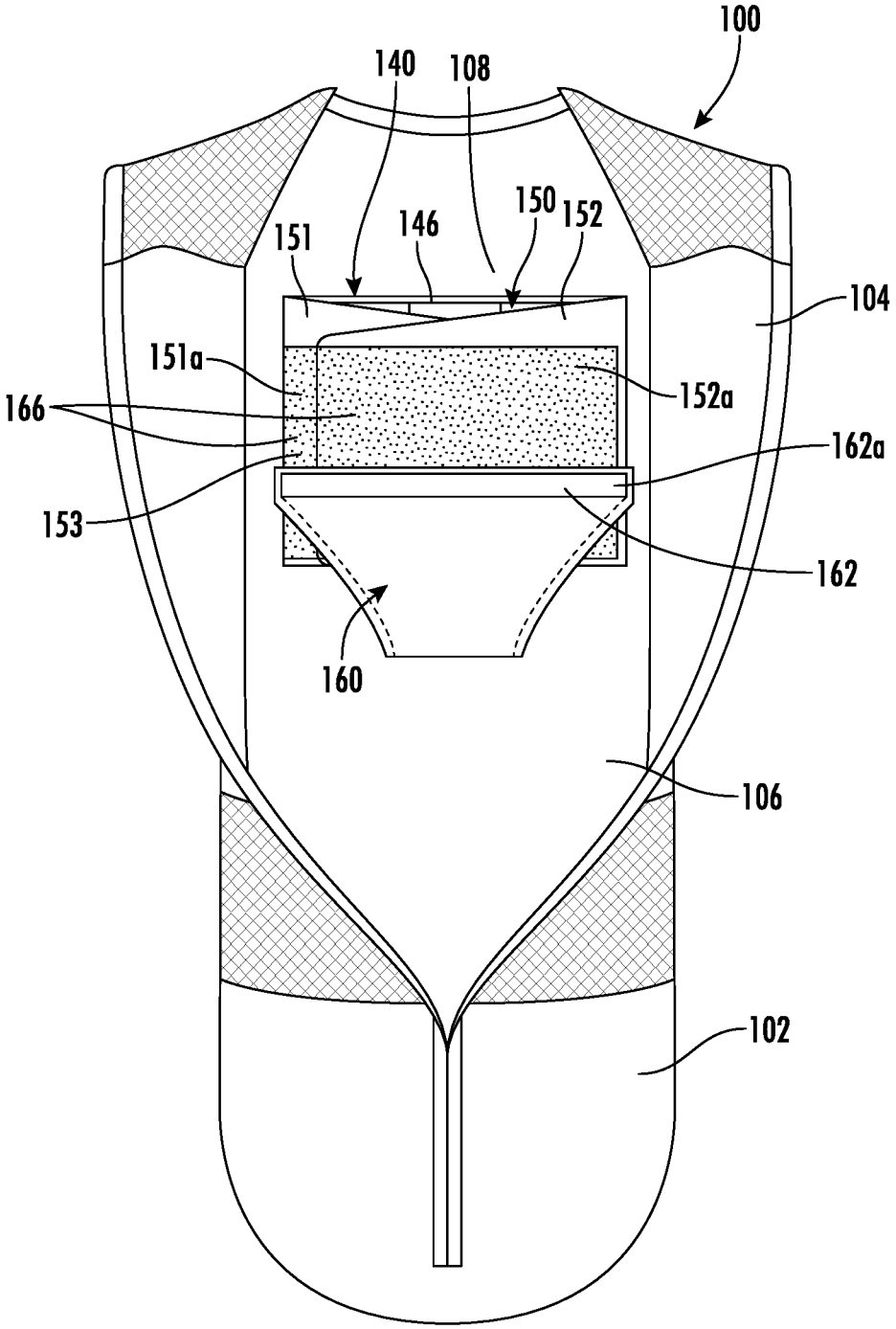
Figure 8C:
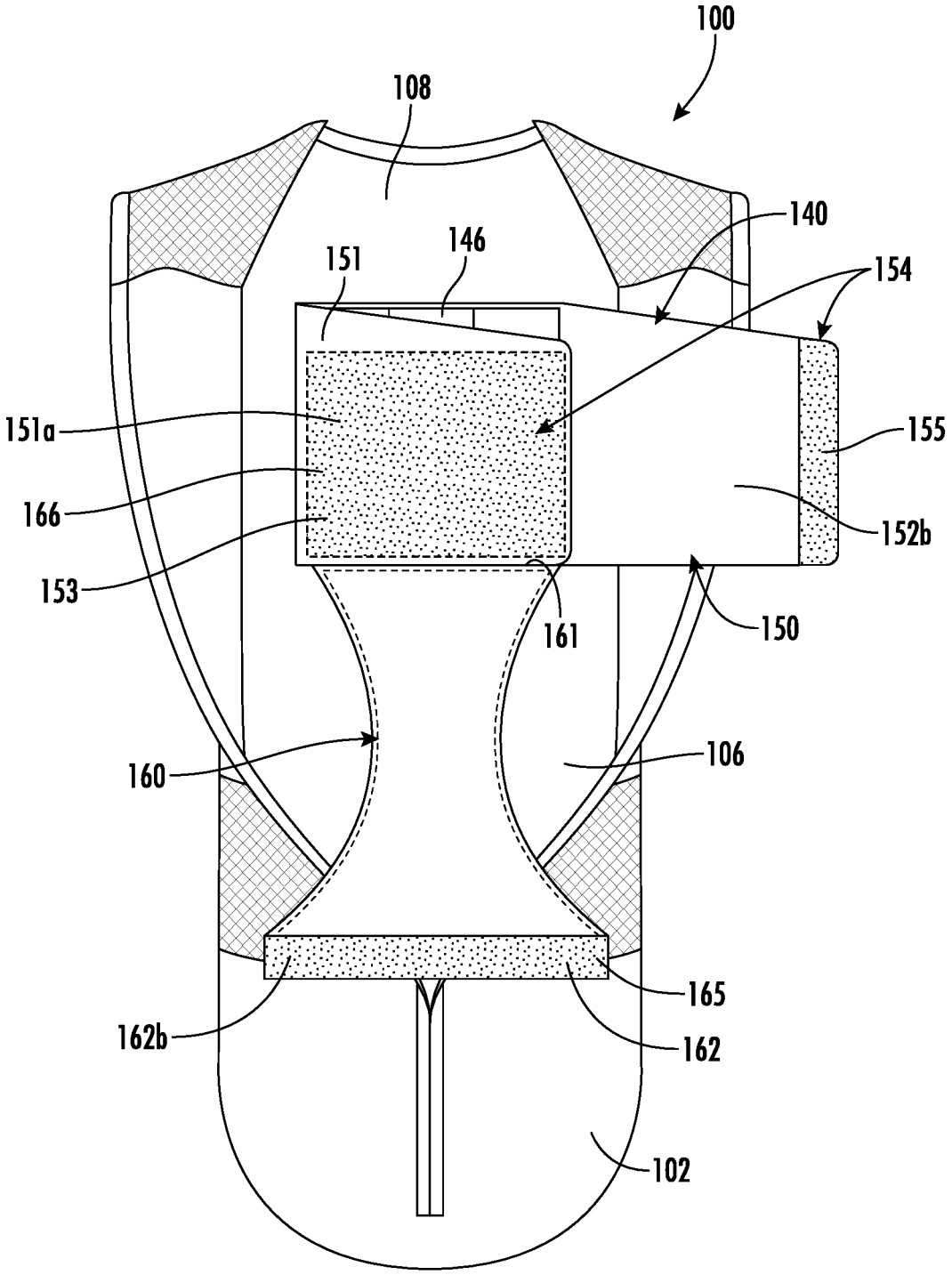
Figure 8D:
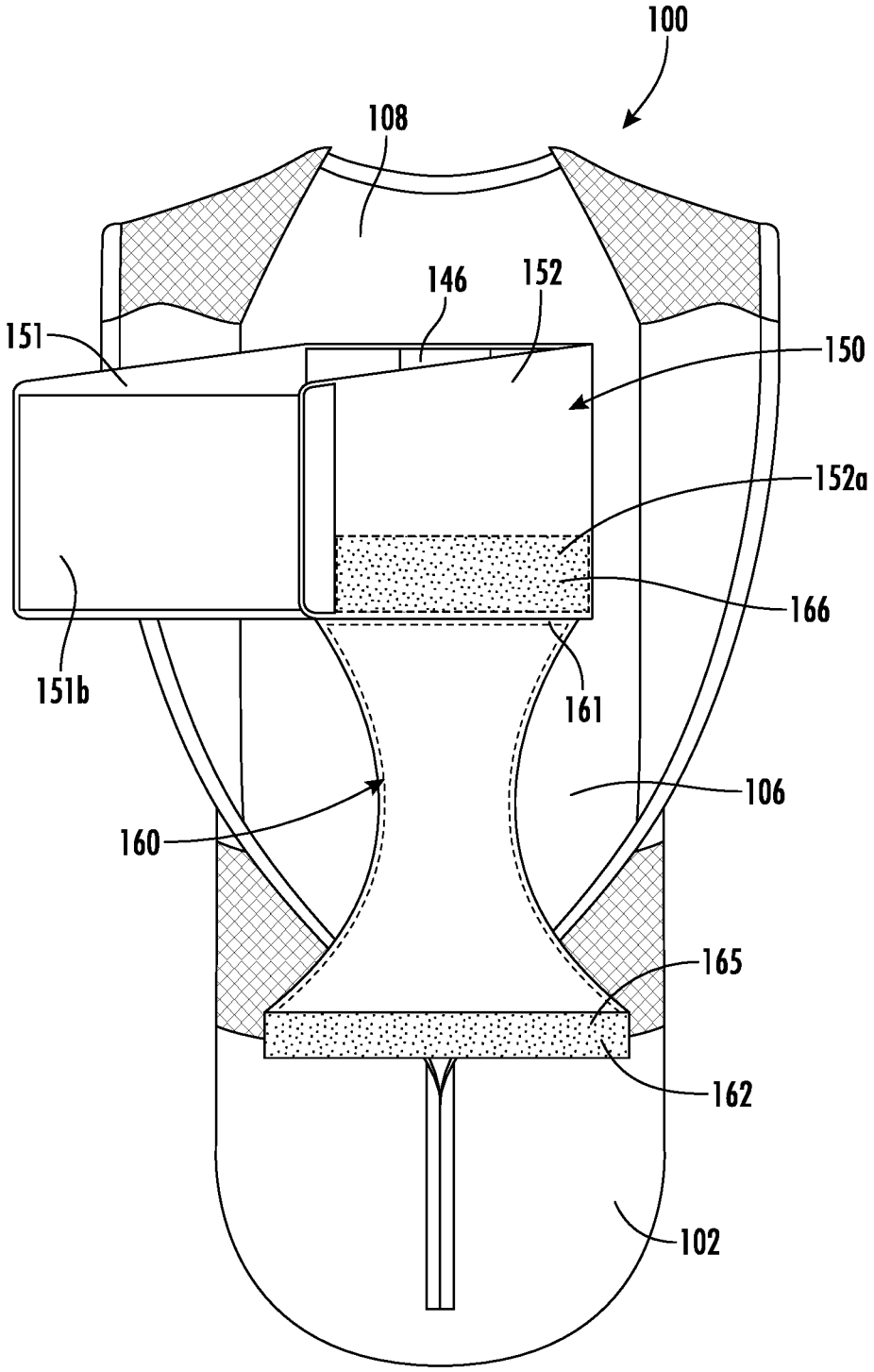

FIGS. 8A-8E provide various views of a swaddle garment 100 as described with respect to FIGS. 1 & 2 including a harness 140 as described above with respect to FIGS. 6A-6C, wherein FIG. 8A illustrates the harness 140 in an open position corresponding to FIG. 6A, and FIG. 8B illustrates the harness 140 in a folded position corresponding to FIG. 6C. FIG. 8C provides a view of the harness 140 wherein the first side 151 of the torso wrap 150 is folded inward over the back side 146 and the second side 152 of the torso wrap 150 is extended outwardly to show the attachment mechanism 154 for selectively coupling the first side 151 and second side 152. The attachment mechanism 154 includes a first attachment structure 153 positioned on the first side 151 and a second attachment structure 155 positioned on the second side 152 wherein the first attachment structure 153 and the second attachment structure 155 are configured to be selectively coupled and decoupled. The attachment mechanism 154 comprises a hook and loop configuration wherein a first attachment structure 153 comprising a loop material is positioned along a surface of an upper side 151*a* of the first side 151 of the torso wrap 150 and a second attachment structure 155 comprising a hook material is positioned along a surface of an underside 152*b* of the second side 152 of the torso wrap 150. As noted above and elsewhere herein, the identities of the hook and loop positions may be swapped. As shown, the first attachment structure 153 extends across substantially all the lateral length of the first side 151 to provide ample locations for attachment to the second attachment structure 155, thereby provided flexibility with respect to size of infant and allowance for infant growth. The second attachment structure 155 extends a vertical length approximately corresponding to that of the first attachment structure 153 to provide greatest attachment area available with a given width of second attachment structure 155. The width of the second attachment structure 155 is less than that of the first attachment structure 153 to limit opportunity for irritation to the infant if contacting a portion of the second attachment structure 155 that does not attach to the first attachment structure 152 in use. It is noted that smaller, larger, or discontinuous attachment structure configurations could also be used. FIG. 8D provides a view of the harness 140 wherein the second side 152 of the torso wrap 150 is folded inward over the back side 146 and the first side 151 of the torso wrap 150 is extended outwardly to show the attachment mechanism for selectively coupling the diaper flap 160 to the arm wrap. The second attachment structure 166 is positioned along the upper side 152*a* of the second side 152 of the torso wrap 150 and selectively attaches to the first attachment structure 165 positioned along the underside 162*b* of the securing end 162. The first and second attachment structures 165, 166 include a hook and loop configuration as described herein, although other attachment structures may be used. FIG. 8D illustrates an alternate configuration of the second attachment structure 166 wherein the vertical length of the second attachment structure 166 is less than that of attachment structures 153, 155, which is less than half in this illustration. The second attachment structure 155 comprise tricot loop material for attaching to the hook material of the first attachment structure. The harness 140 is shown sewn along the back side 106 of the body 102 within the interior space 108. In other embodiments, the harness 150 and body 102 may include corresponding attachment structures configured to attach such as snaps, straps, clips, hook and loop, or other attachment structures for attaching the harness 140 to the body 102. The back side 106 of the body may correspond to the back side 146 of the harness. The back side 146 may be removably attachable using hook and loop, clips, snaps, zippers, or other attachment structures configured to cooperatively removable attach the back side 106 within the swaddle garment. The first side The swaddle garment 100 is designed to prevent extra strong and/or wiggly "Houdini" babies from shifting out of position within the sack. The torso wrap 150 including an arm wrap and the diaper flap 160 provides an additional layer to prevent babies from being able to break out of the swaddle garment 100 and also from moving downwards within the sack. It will be appreciated that the back side 106 of the swaddle garment 100 may include all or a portion of the back side 156 of the harness 150. For example, the first side 151 of the torso wrap 150, second side 152 of the torso wrap 150, and/or the diaper wrap 160 may extend from the back side 106 of the body 102 of the swaddle garment 100 directly. That is, the back side 146 of the harness 140 may correspond to a portion of the back side 106 of the body 102 of the swaddle garment 100 and not include additional material there along. In a further example, the first side 151 of the torso wrap 150, second side 152 of the torso wrap 150, and/or anchor end 161 of the diaper flap 160 may attach or be attachable to the back side 106 of the body 102 swaddle garment 100, corresponding to the back side 146 of the harness 150, at one or more locations, either together, separately, or combinations. Thus, in an embodiment, the torso wrap 150 may include a backing material between the first and second sides 151, 152 that is attached or attachable to the back side 106 of the body 102 of the swaddle garment 100, e.g., via thread, clips, hook and loop, snaps, or other arrangement. In some embodiments, the back side 146 of the harness 140 includes padding material.

Figure 8E:
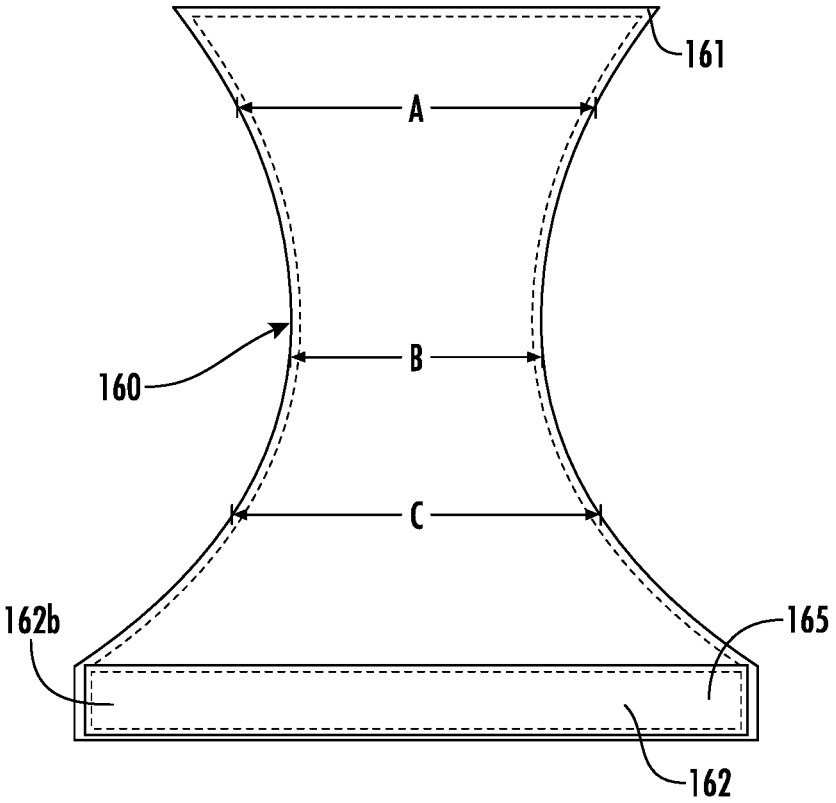

FIG. 8E is an isolated view of the diaper flap 160. The diaper flap 160 extends between an anchor end 161 and a securing end 162. The anchor end 161 is configured to attach to the back side 146 of the harness 140, corresponding to a position just below a lower extent of the torso wrap 150. The securing end 162 of the diaper flap 160 is extendable outwardly from the anchor end 161 with respect to the back side 146 of the harness 140. The securing end 162 includes a horizontal width that corresponds to a portion of a waist of an infant. The horizontal width may be dimensioned to extend over at least a front width of a waist of the infant. Although various combinations of increasing and/or decreasing widths may also be used, the illustrated diaper flap 160 increases and decreases in width between the anchor end 161 and securing end 162, as indicated by widths A, B, and C. The increased width at the anchor and securing ends 161, 162 may improve support, comfort, and durability of the diaper flap 160 while the decreasing and increasing widths along a midsection of the diaper flap 160 may conform to crotch dimensions to provide support and comfort to the infant. While other configurations may be used, as shown, widths A and C are approximately the same and width B represents the minimum width along the diaper flap 160. The radius of curvature between width B and C is less than the radius of curvature between A and B. Thus, the distance between widths B and C is less than that between width A and B. The width at the anchor end 161 is greater than widths A, B, and C but less than the width at the securing end 162. The radius of curvature between the anchor end 161 and width A is less than that between the securing end 162 and width C. The width of the securing end 162 is approximately 110% of the width along the anchor end 161 and approximately 255% of width B. The securing end 162 is configured for removably securing the diaper flap 160 after it has been folded over the crotch of an infant. Attachment mechanism 164 includes a first attachment structure 165 positioned at the securing end 162 and a second corresponding attachment structure 166 for selectively coupling and decoupling the securing end 162 over the crotch of the infant. The first attachment structure 165 may extend the width of the securing end 162. As shown, the first attachment structure 165 extends less than the width of the securing end 162 or approximately 95% of the width of the securing end 162. The first attachment structure 165 comprises a hook material positioned along an underside 162*b* of the securing end 162 and the second attachment structure 166 comprises a loop material positioned along the upper side 152*a* of the second side 152 of the torso wrap 150.

FIGS. 9A-9D illustrate a swaddle garment 100 as described above with respect to FIGS. 3A-3F including a harness 140 as described above with respect to FIGS. 6A-6C and FIGS. 8A-8E. FIGS. 9A-9D also illustrate a method of harnessing an infant with respect to a swaddle garment in a manner similar to that described with respect to FIGS. 7A-7E. The swaddle garment includes attachment structures 114*a* configured for attachment to corresponding attachment structures associated with a sleep surface, such as that described with respect to FIGS. 4 & 5. The harness 140 may be attached, e.g., sewn along the back side 106 of the body 102 within the interior space 108 or may include attachment structures configured to attach to corresponding attachment structures wherein the attachment structures include snaps, straps, clips, hook and loop, or other attachment structures for attaching the harness 140 to the body 102.

The harness 140 includes a torso wrap 150 having a first side 151 and a second side 152 configured to together wrap around a torso of an infant 170. The first side 151 and second side 152 are preferably dimensioned to further wrap around arms of the infant to secure the arms to sides of the infant, which may be optional. In FIG. 9A, the infant 170 is positioned over the harness with its back positioned over the back side (not visible) of the harness 140 or swaddle garment 100. The first side 151 of the torso wrap 150 is folded over a side of the torso of the infant including an arm. The second side 152 of the torso wrap 150 is extended outwardly, beneath the other arm of the infant 170. The diaper flap 160 is extended outwardly, between the legs of the infant 170.

Figure 9B:
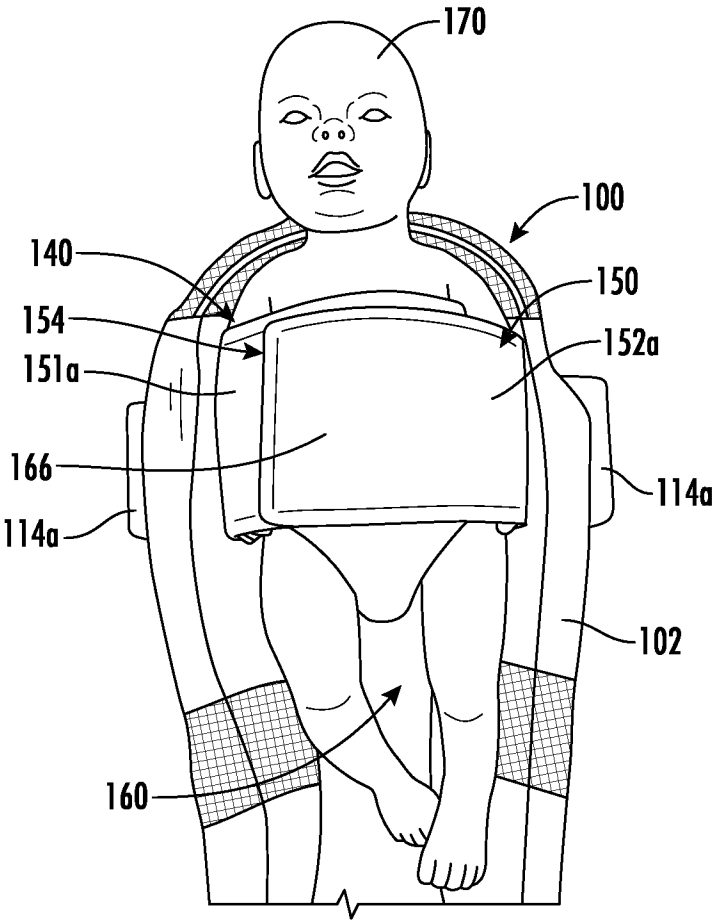
FIGS. 9A-9D illustrate a process of securing an infant within an infant swaddle garment including an interior harness according to various embodiments described herein.
Figure 9A:
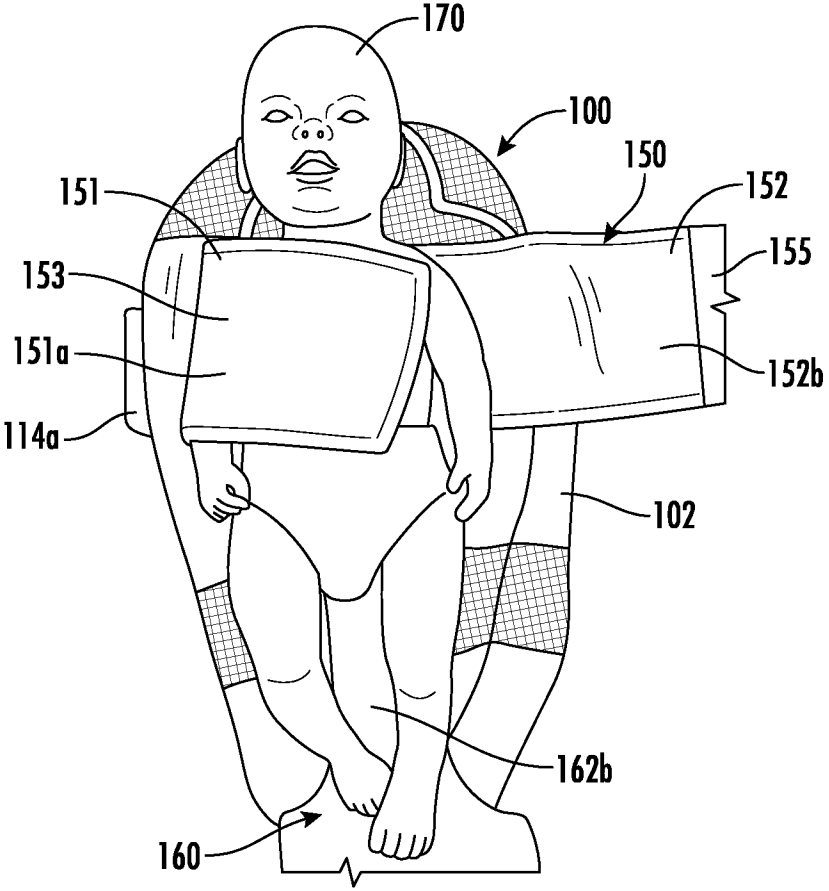

In FIG. 9B, the second side 152 is extended around the torso, including the other arm, of the infant 170 and the first and second sides 151, 152 are coupled via an attachment mechanism 154. The attachment mechanism 154 may be configured as described above and elsewhere herein. For example, a first attachment structure 153 comprising a loop material, such as polyester tricot, may be disposed along the first side 151 and may be coupled with a second attachment structure 155 comprising a hook material disposed along the second side 152. The attachment mechanism 154 may provide an adjustable girth as described above and elsewhere herein. In the illustrated embodiment, the first attachment structure 153 is disposed along an upper side 151*a* of the first side 151 and the second attachment structure 155 is disposed along an underside 152*b* of the second side 152. The first and second sides 151, 152 extend from just below the top of the shoulders of the infant to below the wrists and may cover a portion of the hands. For example, a vertical length of the first side 151 and/or second side 152 is dimensioned to extend below wrists of the infant 170 and above elbows of the infant, but below shoulders of the infant 170. In some embodiments, the torso wrap 150 extends across the chest of the infant 170 approximately along or just below armpits of the infant 170. The torso wrap 150 may be configured such that the torso wrap 150 extends around the waist and all or a portion of the hips of the infant 170 while also securing arms to the side of the infant 170. The torso wrap 150 may extend over a stomach including a navel. In some embodiments, the lower extent of the torso wrap 150 extends beyond the wrists of the infant 170 when secured to the sides of the infant 170 such that the arm wrap 150 extends around the wrists and at least a portion of the hands of the infant 170.

Figure 9D:
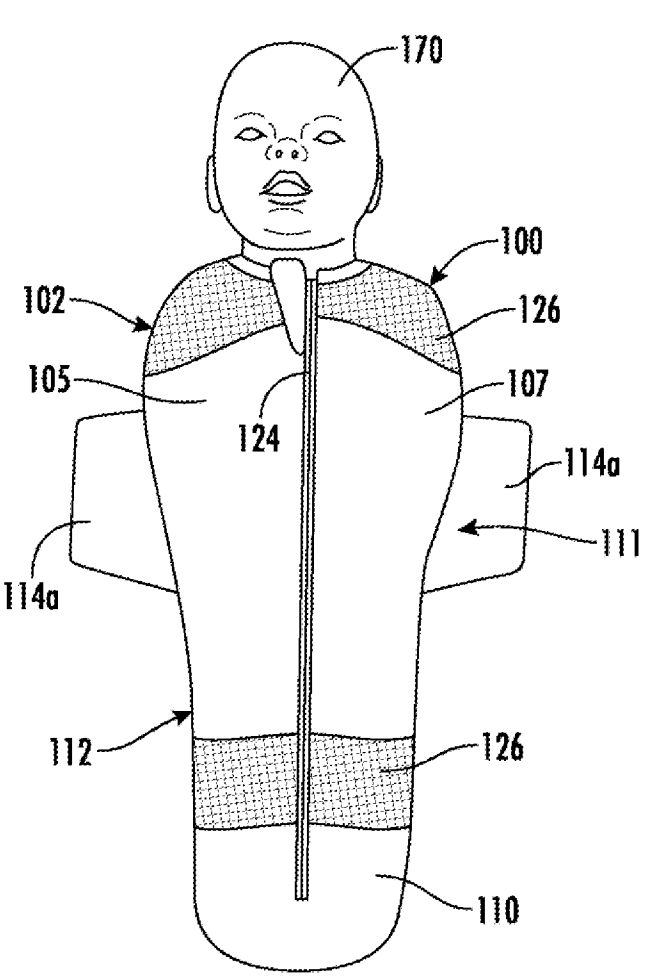
Figure 9C:
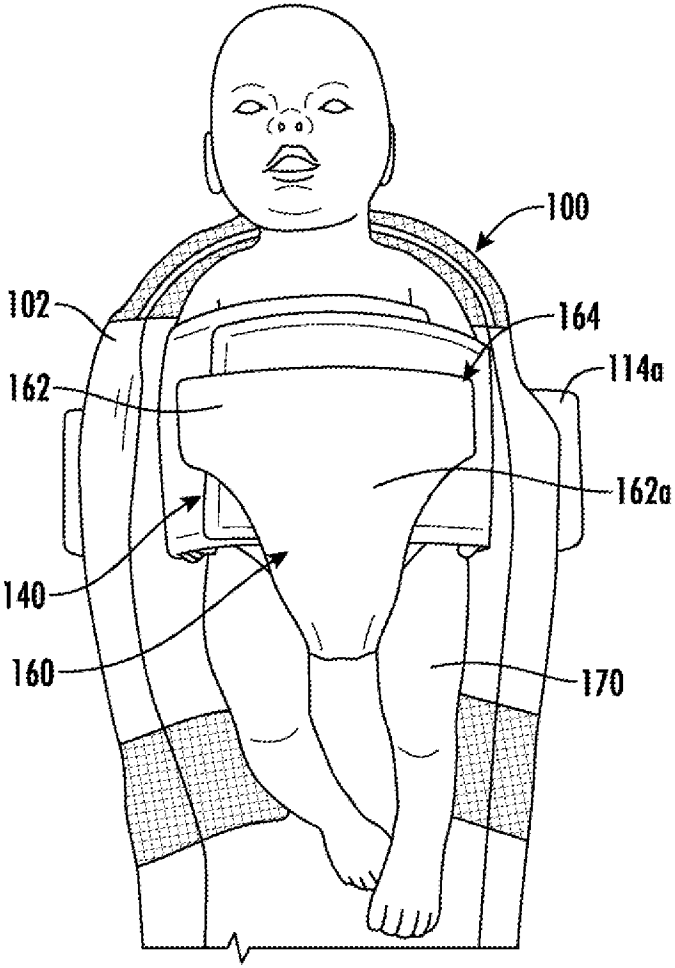

With particular reference to FIG. 9C, the diaper flap 160 extends between an anchor end (not visible) and a securing end 162. The securing end 162 of the diaper flap 160 is extendable outwardly from the anchor end 155a with respect to the back side 146 of the harness. The securing end 162 is configured for removably securing the diaper flap 160 after it has been folded over the crotch of an infant 170. The diaper flap 160 is shown after being brought through the legs of the infant 170 and secured to the torso wrap 150 via an attachment mechanism 164. The attachment mechanism 164 may be configured as described above and elsewhere herein. In the illustrate example, a first attachment structure (not visible) disposed along an underside 162*b* of a securing end 162 of the diaper flap 160 couples to a second attachment structure 166 disposed on upper sides 151*a*, 152*a* of both the first and second sides 151, 152 of the torso wrap 150. The first attachment structure comprises a hook material and the second attachment structure 166 comprises loop material, such as polyester tricot. The securing end 162 includes a horizontal width that may correspond to approximately an average to ninetieth percentile width of torso of an infant, although larger or smaller widths may be used. To provide adjustable sizing and a snug fit, the second attachment structure 166 provides multiple locations, see, e.g., 166*a*, 166*b*, 166*c* in FIG. 6B, to which the first attachment structure may secure the diaper flap 160. The second attachment structure 166 includes horizontally and vertically extending lengths of loop material along the upper sides 151*a*, 152*a* of the first and second sides 151, 152 of the torso wrap 150.

In FIG. 9D, sides 105, 107 of a swaddle garment 100 are coupled to envelope the harnessed infant 170 within an interior space thereof. As noted above, the harness 140 may be attached to or attachable to a swaddle garment 100, which may include a sleep sack or enclosure.

Figure 22:
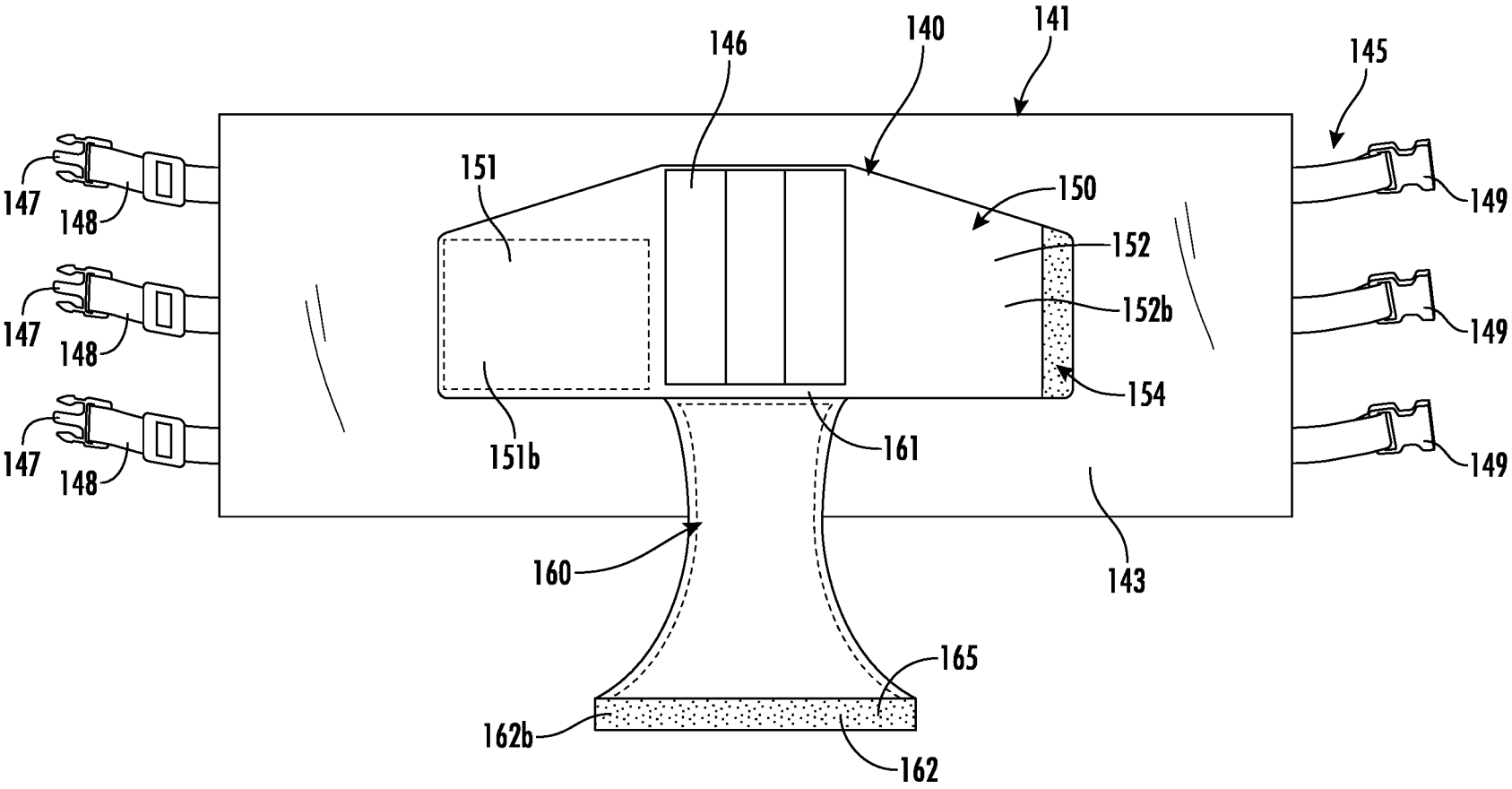
FIG. 22 illustrates a harness according to various embodiments described herein.

FIG. 22 illustrates another embodiment of a harness 140 wherein the harness 140 is configured to be removably attached to a mattress or platform. The harness 140 may be as described above with respect to FIGS. 6A-6C, wherein like features are identified with like numbers and FIG. 22 illustrates the harness 140 in an open position corresponding to FIG. 6A. The harness 140 is attached or attachable to a support 141 configured to support a position of the harness 140 when removably attached to a mattress or platform. In the illustrated embodiment, the support 141 comprises a sheet 143 to which the harness 140 attaches along its backside 146 via a threaded, adhered, or other secure connection. In some embodiments, the harness 140 may removably attach to the sheet 143 via hook and loop or other removable attachment structure. The support 141 is configured to removably attach to a mattress or platform. In some embodiments, the support 141 comprises a fitted sheet with elastic corners dimensioned to fit a mattress. In one embodiment, a fitted sheet may include adjustable straps extending across each corner of the sheet, between adjacent lateral and upper or lower sides of the corner. The adjustable straps may be used to fit the sheet to multiple mattress sizes. In the illustrated embodiment, the support 141 includes an attachment mechanism 145 configured to removably attach the support 141 to a mattress. Various attachment mechanisms 145 may be used such as clips, snaps, buttons, hook and loop, interference or press fit, for example. As illustrated, the attachment mechanism 145 includes clips 147, 149 configured to clip together beneath a mattress to removably attach the support 141 and harness 140 to a mattress. The attachment mechanism 145 may include adjustable length straps 148 to allow a user to adjust the length of the straps 148 to fit different size mattresses. The support 141 may be configured to extend around a mattress such that a portion of the support 141 extends beneath the mattress. For example, all or a portion of the attachment mechanism 145 may extend beneath the mattress. In one example, the attachment mechanism 145 may attach to itself, e.g., clips 147, 149 beneath the mattress or along a side of the mattress. The harness 140 and support 141 may attach to a mattress or sleep device (see, e.g., FIG. 4) having a movable platform (e.g., side-to-side, up-and-down, head-to-toe, rotation, vibration, etc.) to secure an infant with respect to the mattress or platform during movement. In one embodiment, the sleep device comprises a sleep device or bassinet having a movable platform as described in U.S. patent application Ser. No. 15/336,519, filed Oct. 27, 2016, titled Infant Calm/Sleep-Aid, SIDS Prevention Device, and Method of Use. While shorter length torso wraps 150 configured to leave arms and wrists of the infant free and extend over the chest of the infant, below the arm pits, may be used, when used with a movable mattress and/platform, the torso wrap 150 is preferably configured to be long enough in length to secure arms and/or wrists to the sides of the infant. However, in one embodiment, an arms free torso wrap 150 may be used with a sleep device comprising a movable platform.

In various embodiments, the harness may be utilized with a sleep garment or enclosure described in U.S. patent application Ser. No. 16/282,091, filed Feb. 21, 2019, titled *Infant Sleep Garment*. The disclosure of which is hereby incorporated herein by reference.

In various embodiments, a swaddle garment or enclosure for receiving a swaddle garment includes or is configured to associate with a first accommodation mechanism comprising a support element configured to support legs of an infant at an elevated angle relative to hips of the infant. For example, a support element comprising a wedge, cylinder, roll, or other dimensioned support structure may be positioned within an interior space along a back side of a swaddle garment shown in FIGS. 1-3D. The support element may be positioned along the third portion and/or second portion to support at least a portion of the lower body of the infant to elevate hips and feet of the infant relative to the at least a portion of the upper body of the infant. For example, the support element may support the legs of the infant at an elevated angle relative to the hips of the infant. The first accommodation mechanism may include but is not limited to any mechanism configured to receive the support element, such as a pocket, an enclosure, a strap configured to attach to a clip, an elastic strap, a hook and loop attachment mechanism, a push snap attachment, a zipper mechanism, a magnetic attachment mechanism, or any similar mechanism configured to receive the support element. In some embodiments, the support element may removably attach to the back side via straps, clips, snaps, hook and loop, or other suitable attachment structures. In one embodiment, the back side may include a pocket for receiving the support element. In another embodiment, the support element may be sewn to the back side.

Various support elements may be configured to define different shapes and dimensions in accordance to the principles disclosed there. In an embodiment, a surface of the support element is flat, inclined upwardly or downwardly, rounded, recessed, partially inclined or any combination thereof. In an embodiment, the surface may be inclined from one end to another end. In an embodiment, a support element may comprise a flat surface. In one embodiment, the support element may comprise a first portion and a second portion, wherein the first portion includes a flat surface and the second portion includes an inclined surface. The inclined may be dimensioned to promote a desired elevated angle between the legs and hips of the infant. In an embodiment, the elevated angle may be between 30 and 160 degrees, which is a range that may be effect in comforting certain infants. The raising of an infant's legs to within this range may preferably relax the infant's abdomen muscles, promoting a calming reflex. In an embodiment of a support element, there may be multiple upwardly or downwardly inclined, flat, or otherwise shaped portions from a proximal to a distal end. A support element may comprise other shapes and geometries in accordance to the principles disclosed herein. For example, in an embodiment, a surface of the support element may be contoured to accommodate each leg of an infant separately. In an embodiment, the height of a distal end of the support element may be lower than that of the proximal end.

In an embodiment, the support element upon being associated with the swaddle garment, may be located outside the interior space. For example, the swaddle system may include an outer enclosure for receiving at least a portion of the body of the swaddle garment within an enclosure space defined by the enclosure. The enclosure may include, e.g., integrate, attach, or receive, a support element in a manner and location described above and elsewhere herein, such as within a compartment or pocket.

In various embodiments, a swaddle garment or enclosure for receiving a swaddle garment includes or is configured to associate with a second accommodation mechanism including or configured to receive a weight element. In an embodiment, a swaddle garment may be configured to receive a weight element at a location to thereby apply pressure to the infant's upper body, lower body, or both upper and lower body simultaneously. In one example, the second accommodation mechanism may be positioned to locate the weight element along or over the first portion along the front side of the swaddle garment body. For instance, a swaddle garment may include a pocket or attachment structure along the front side of the body to receive or couple with the weight element over the first portion of the interior space corresponding to an upper body of an infant. In various embodiments, the front side of the body includes a connector for coupling to the weight element a strap configured to attach to a clip, an elastic strap, a hook and loop attachment mechanism, a push snap attachment, a zipper mechanism, a magnetic attachment mechanism, or any similar mechanism.

It is to be appreciated that embodiments including an accommodation mechanism may include a first accommodation mechanism, a second accommodation mechanism, or both. Thus, a sleep garment may include a harness for harnessing an infant and one or both of a first accommodation mechanism including or configured to associate with a support element or a second accommodation mechanism including or configured to associate with a weight element. In some embodiments, a swaddle garment includes an enclosure, which may be an outer enclosure, for enclosing the body of the swaddle garment within an interior space of the enclosure. The enclosure may include one or both of a first accommodation mechanism including or configured to associate with a support element or a second accommodation mechanism including or configured to associate with a weight element. In some embodiments, a swaddle garment does not include an accommodation mechanism. In another embodiment, a body of a swaddle garment includes an accommodation mechanism and is received within an enclosure including another accommodation mechanism.

Figure 10:
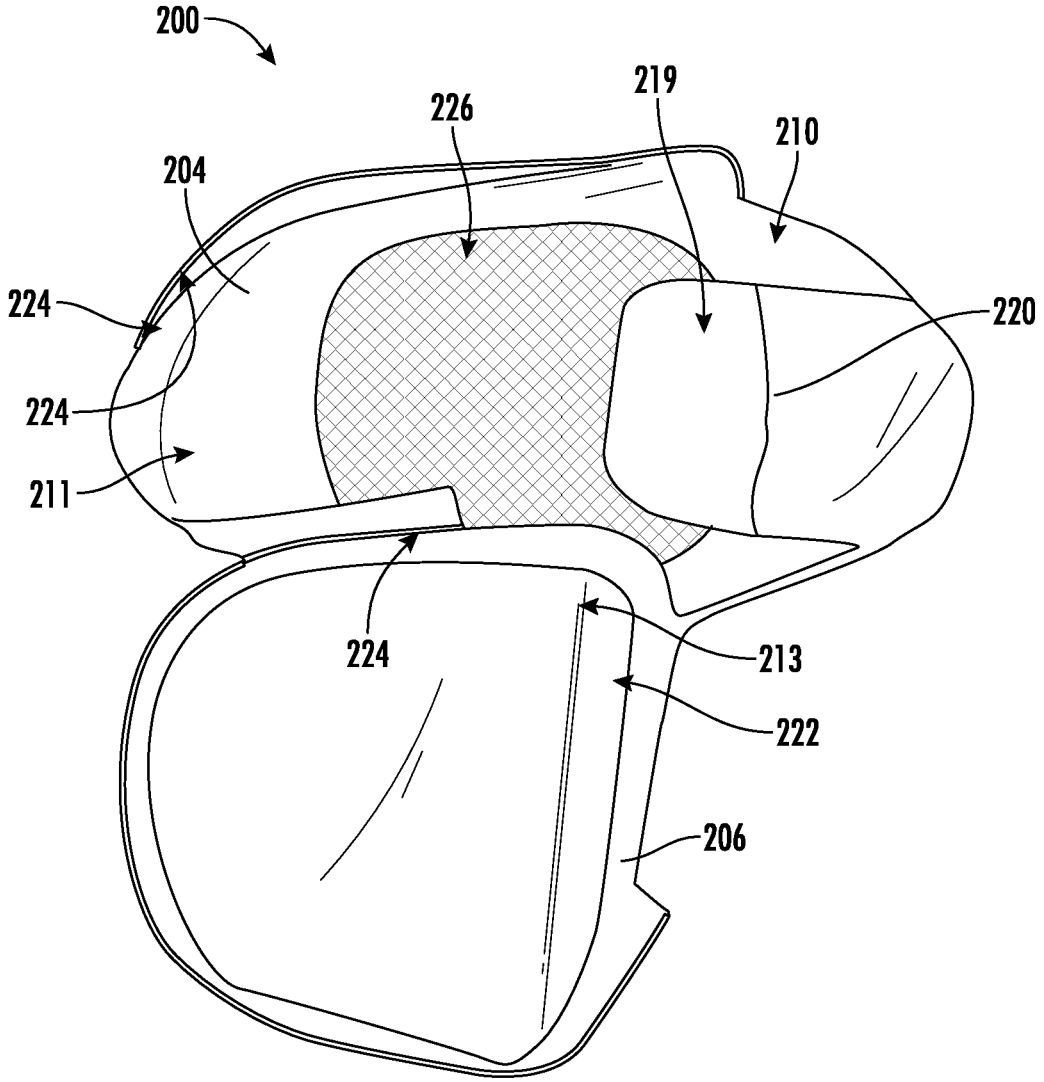
FIG. 10 illustrates an enclosure in an open position according to various embodiments described herein.
Figure 11:
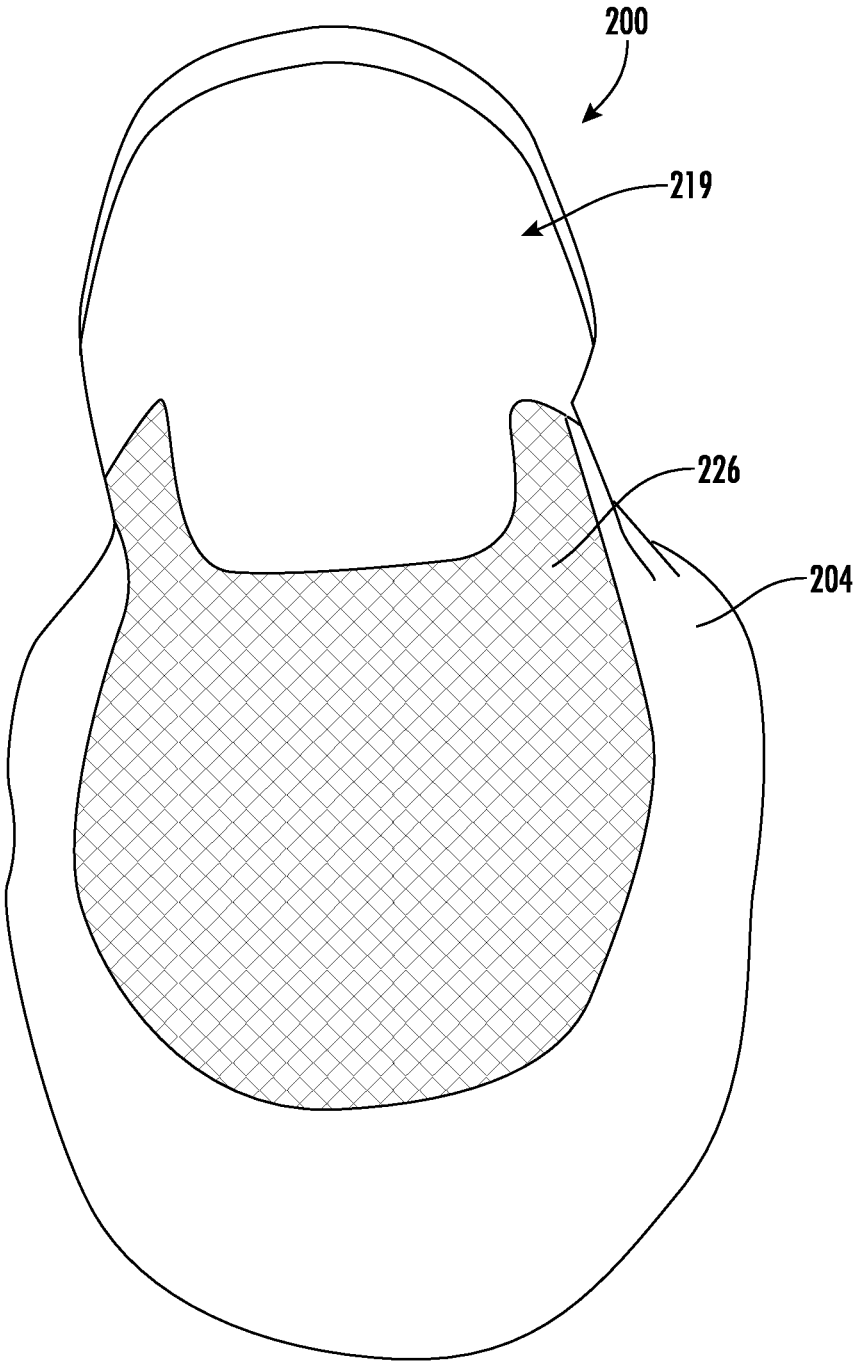
FIG. 11 illustrates a front side view of the enclosure of FIG. 10 in an enclosed position according to various embodiments described herein.
Figure 12:
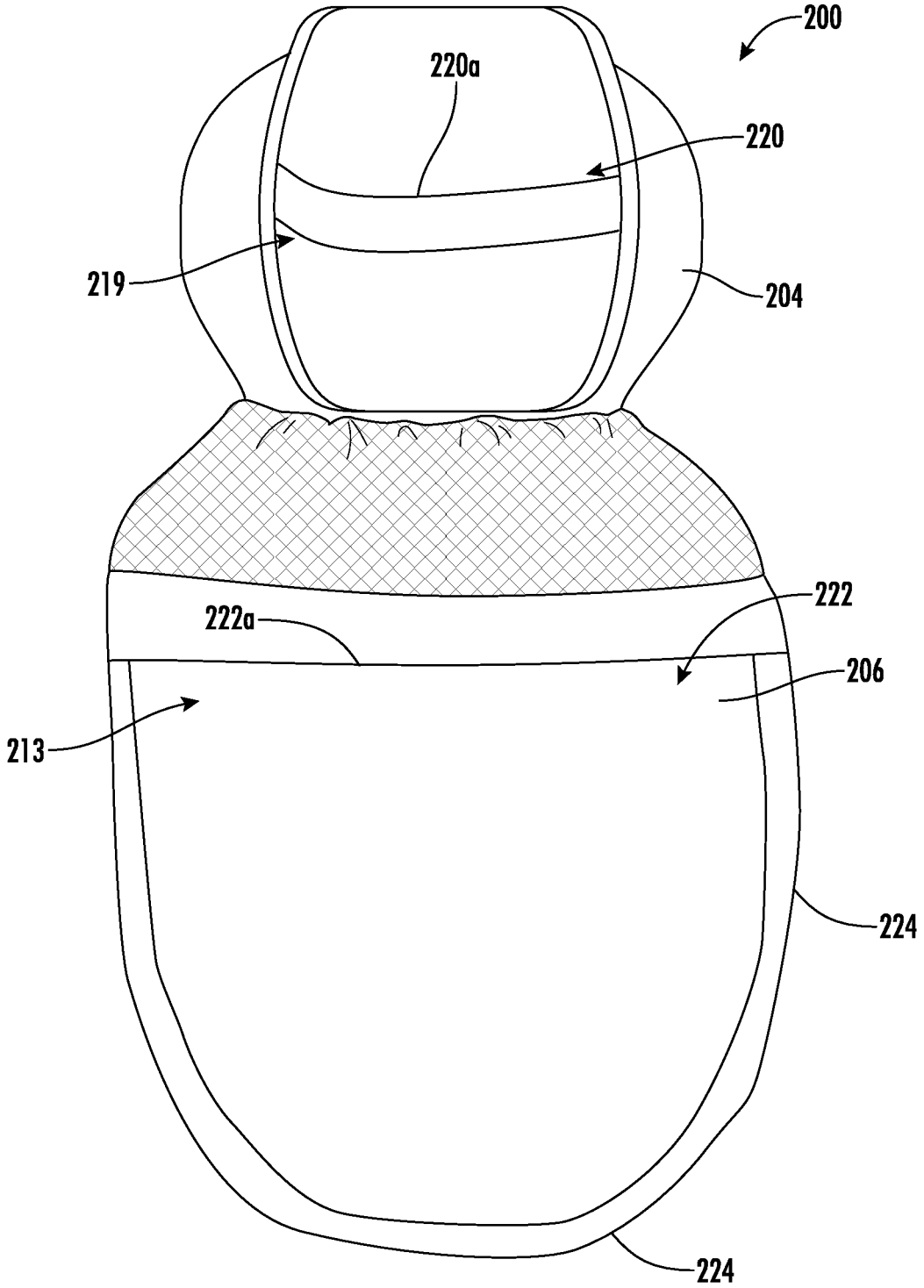
FIG. 12 illustrates a back side view of the enclosure of FIG. 10 in an enclosed position according to various embodiments described herein.
Figure 13:
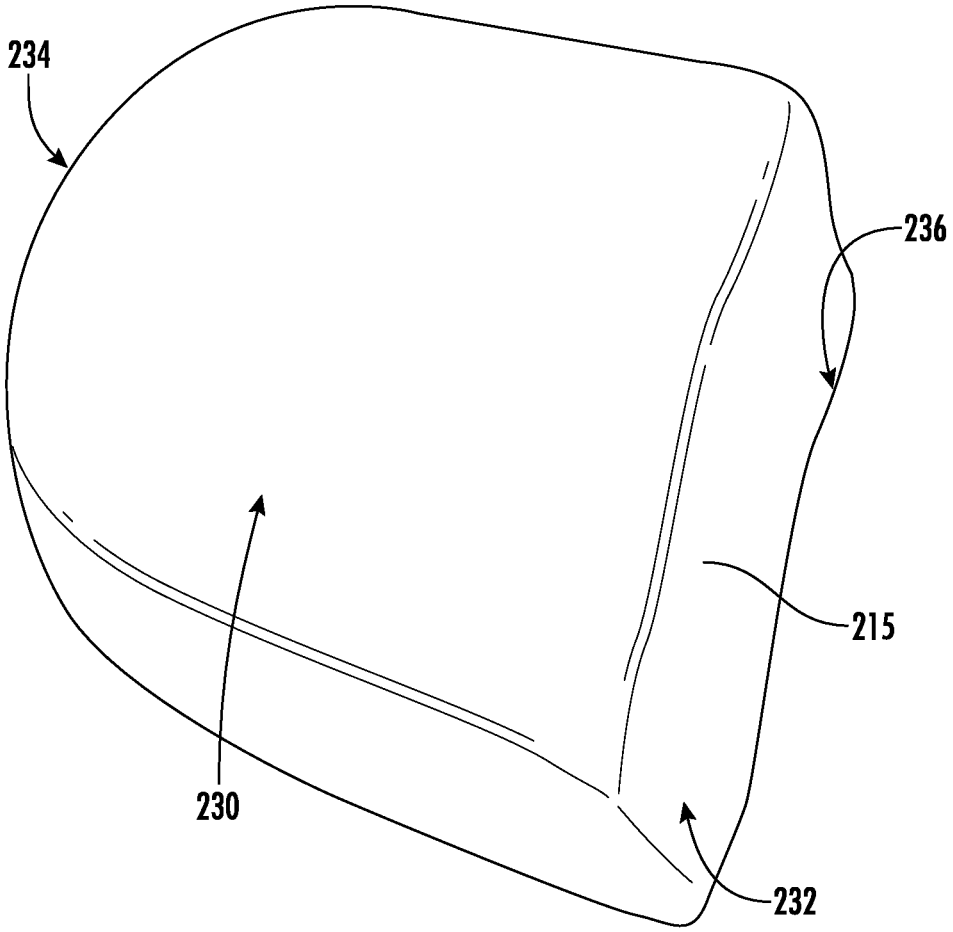
FIG. 13 illustrates a support element according to various embodiments described herein.

FIGS. 10-12 illustrate an embodiment of an enclosure 200 of a swaddle system for enclosing a swaddle garment, which may include a swaddle garment including a harness as described herein. It will be appreciated that the enclosure 200 may find use with swaddle garments that do not include a harness (e.g., as described with respect to FIGS. 1-3D) and/or without a swaddle garment. FIG. 10 shows the enclosure 200 in an open position. FIG. 11 shows a front view of the enclosure 200, and FIG. 12 shows a back view of the enclosure 200. FIG. 13 illustrates an example support element 215 for use with the enclosure 200.

The enclosure 200 includes a body 202 comprising a front side 204 and a back side 206. The front side 104 and back side 206 are couplable via operation of an attachment device 224 that extends around corresponding perimeters of the front and back sides 204, 206. When enclosed around an infant, the enclosure defines an enclosure space 208. A first portion 210 of the enclosure space 208 is configured to accommodate a torso beneath a front side 204 of the enclosure and a second portion 211 of the enclosure space 208 is configured to accommodate legs of the infant between the front side 204 and the back side 206. In the illustrated example, the back side 206 does not define the first portion 210 of the enclosure space 208; however, in other embodiments, the back side 206 may extend below the front side 204 to form a portion of the first portion 210. In some examples, the back side 206 may extend below hips of an infant.

The enclosure 200 includes a first accommodation mechanism 213 positioned along the back side 206 and a second accommodation mechanism 219 positioned along the front side 204. The first accommodation mechanism 213 comprises or is configured to couple with a support element 215 (see, e.g., FIG. 13) to position the support element 215 along the second portion 211. The support element 215 is configured to support the infant's legs at an elevated angle relative to the infant's hips. In FIG. 10, the first accommodation mechanism 213 includes a compartment 222 housing a support element 215 (see, e.g., FIG. 13), not visible. The compartment 222 may be configured to selectively associate with support element 215 or may permanently integrate the support element 215. In some embodiments, the support element 215 may be sewn along the back side 206. As best shown in the rear view provided in FIG. 12, the compartment 222 comprises a pocket having flap opening 222*a* that may be manipulated to reveal an opening for receiving the support element 215. Other opening configurations may be used, such as but is not limited to straps, clips, hook and loop attachments, push snap attachments, zipper mechanisms, magnetic attachment mechanisms, or any similar mechanism.

FIG. 13 illustrates an embodiment of a support element 215. The support element 215 comprises a first portion 230 and a second portion 232. The first portion 230 comprises an approximately flat area, while the second portion 232 inclines from a proximal end 236 to a distal end 234. Support element 215 at the first portion 230 comprises an approximately constant thickness, and has a rounded, bullnose shape at the distal end 234 and an approximately straight edge at the proximal end 236. The support element 215 may include other dimensions. For example, the support element 215 may comprise a generally cylindrical shape to produce bend in hips and elevate feet of an infant. In some embodiments, the support element 213 may include a decline in height between the proximal end 236 to the distal end 234. The support element 215 may include but is not limited to a foam material, a cushion, an air pocket, or any material configured to support an infant's legs in an elevated angle relative to the infant's torso. The support element may further comprise a fabric case (not shown) surrounding the supportive material. The support element may have a resistance to deformation configured to support the infant's legs in the elevated position according to the principles disclosed herein. The support element and/or the fabric case may also be resistant to liquid or biological materials. In various embodiments, the support element 215 may include contours such as indentations to nest the legs. For example, first portion or a top surface, distal facing surface, or proximal facing surface of the support element 215 may include a first indentation to nest a first leg and a second indentation to nest a second leg. Thus, the surfaces within and/or adjacent to the indentations may rise above a back of a leg. In some embodiments, the surfaces within and/or adjacent to the indentations may contact sides of a leg or provide vertically extending obstructions to lateral leg movement. The indentations may be of a constant width or may tapper to a reduced width within indentation valleys. The indentations may have planar bases or may include rounded or arcuate laterally extending base surfaces. It will be appreciated that height of the support element 215 or vertical distance the support element 215 extends as described herein is intended to be in reference to the top surface upon which the back or legs or feet are supported.

The second accommodation mechanism 219 comprises or is configured to couple with a weight element (not shown) for applying pressure to an infant's torso. In the illustrated embodiment, the second accommodation mechanism 219 comprises a compartment 220 for receiving the weight element (not shown) therein. The compartment 220 comprises a pocket having flap opening 220*a* that may be manipulated to reveal an opening for receiving the support element 215. Other opening configurations may be used, such as but is not limited to straps, clips, hook and loop attachments, push snap attachments, zipper mechanisms, magnetic attachment mechanisms, or any similar mechanism. In some embodiments, the enclosure 200 includes one or more connectors for coupling the weight element to the enclosure 200. For example, the weight element may be received along the front side 204 by a connector, which may include but is not limited to any of the following: a strap configured to attach to a clip, an elastic strap, a hook and loop attachment mechanism, a push snap attachment, a zipper mechanism, a magnetic attachment mechanism, or any similar mechanism.

In an embodiment, the weight element may weigh between 1 ounce and 3 pounds, preferably between 0.5 and 1.5 pounds, between 1 and 1.5 pounds, or about 5 pounds, about 0.75 pounds, about 1 pound, about 1.25 pounds, or about 1.5 pounds, or about 1.75 pounds. By positioning the weight element at a location proximate an infant's chest, the pressure applied by the weight element may elicit a calming response from the infant, aiding in the sleep of the infant. Further, upon being received, the weight element may be fixed relative to an infant within the enclosure, and may be prevented from interfering with the sleep of the infant. In an embodiment, the pressure applied by weight element may be distributed over the chest and stomach of the infant. In an embodiment, the pressure from the weight element may be at least partially distributed over the lower body of the infant as well. In an embodiment, the weight element may be received at an alternate location to thereby distribute a portion of the weight over the upper body and a portion of the weight over the lower body.

Further to the above, the weight element may be positioned and/or received at a location corresponding to the upper body or second portion 211 of the enclosure space 208 at the location 134 proximate to the second portion 112 at the first side 104 of the body 102 by connecting the weight element 134 to the second portion 112 by a connector (not shown) which may include but is not limited to any of the following: a strap configured to attach to a clip, an elastic strap, a hook and loop attachment mechanism, a push snap attachment, a zipper mechanism, a magnetic attachment mechanism, or any similar mechanism.

In an embodiment, the weight element 132 may comprise any weighted material suitable to provide the desired weight, which may include for example a metal, a plastic, a ceramic, a polymer, gel, liquid, a composite, a natural, or an artificial synthetic. Furthermore, the weight element may be flat, round, irregular or any other shape and further may be any size so as to be effective for its functions described herein.

An infant may be placed proximate to enclosure 200, with the infant's hips adjacent to support element 215 and legs positioned on a top surface of support element 215. A user may then operate attachment device 224 to couple the front side 204 on top of back side 206. Front side 204 will then be located above the infant, with compartment 220 positioned proximate to the infant's torso. A weight element within the compartment 220 may apply pressure to the body of the infant while the support element 215 elevates the lower body of the infant.

The enclosure 200 may include one or more portions including mesh material 216. In the illustrated embodiment, a portion of front side 204 and a portion of the back side 206 comprise a mesh fabric 216 for allowing air to move therethrough. The back side 206 may include an elastic material along an upper portion configured to stretch and provide a snug fit around the waist or torso of the infant. While only a single front side 204 and back side 206 are illustrated, it will be appreciated that the front side 204 and/or back side 206 may include multiple expanses of material. For example, the front side 204 may include a right side and a left side or a lower side and an upper side.

As noted above and elsewhere herein, the enclosure 200 may be configured to enclose an infant, which may include an infant in a swaddle garment. When a swaddle garment is located between the front side 204 and back side 206, the enclosure 200 may accommodate the swaddle garment. In an embodiment, the enclosure 200 may be configured to attach to a sleep surface, such as a sleep surface described herein (see, e.g., FIG. 4 and accompanying description). In an embodiment, upon enclosure 200 accommodating a swaddle garment therewithin, the swaddle garment may be configured to attach to a sleep surface, thereby also fixing enclosure 200 to the sleep surface. By attaching the enclosure 200 to a sleep surface, an infant accommodated within enclosure 200 may be prevented from rolling over or otherwise moving into an unsafe disposition.

Figure 14:
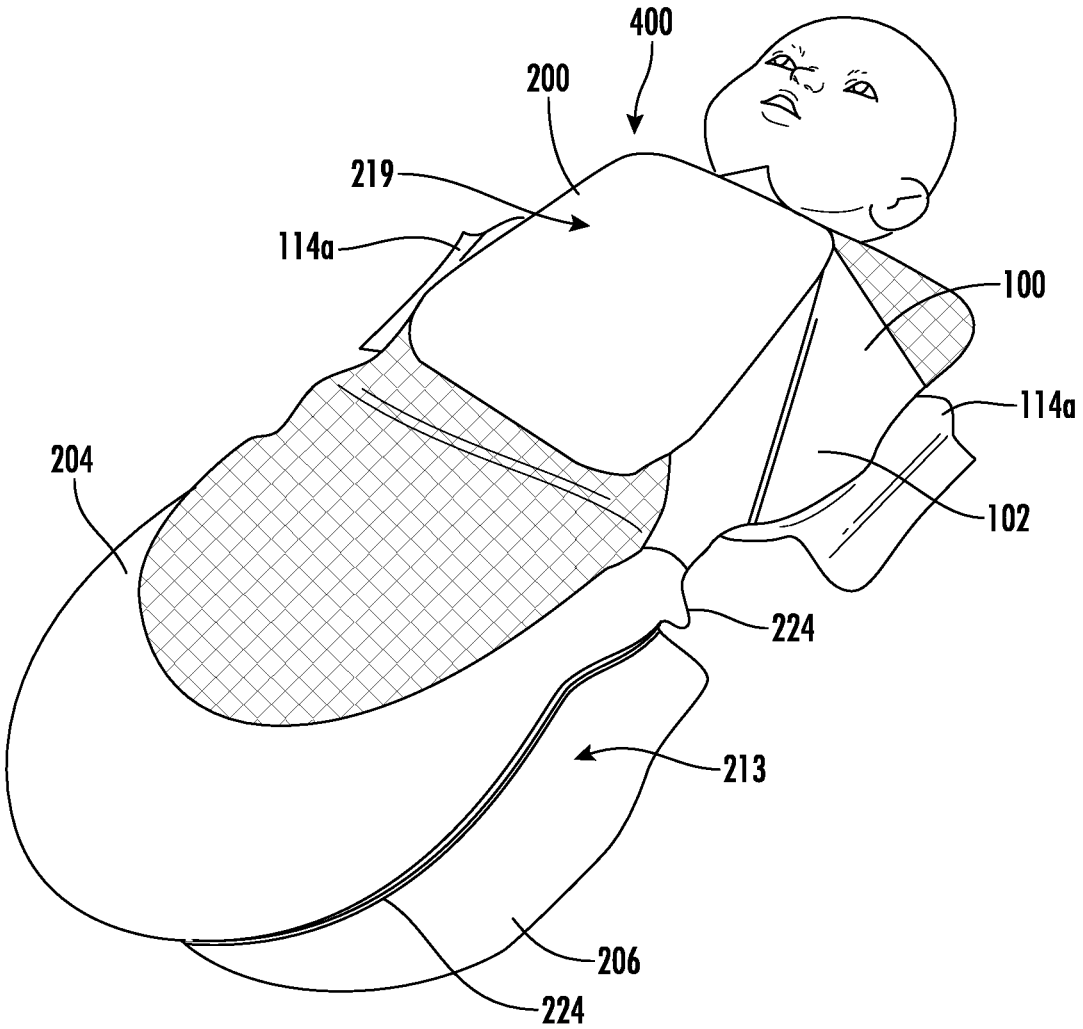
FIG. 14 illustrates a swaddle system according to various embodiments described herein.

FIG. 14 illustrates a swaddle system 400 comprising an enclosure 200 as described above with respect to FIGS. 10-12 and a swaddle garment 100 comprising a harness (not visible) as described with respect to FIGS. 9A-9D. However, other swaddle garment configurations may similarly be used, such as any of those described herein, e.g., a swaddle garment described with respect to FIGS. 1-3F and FIGS. 8A-8E. The swaddle garment 100 is positioned between the front side 204 and back side 206 of the enclosure 200. An attachment device 224 comprising corresponding zipper halves that extend around corresponding perimeters of the front side 204 and back side 206 are mated to enclose the swaddle garment 100. The first accommodation mechanism 213 includes a support element (not visible) that extends beneath the legs of the infant to elevate the legs relative to the hips of the infant. The second accommodation mechanism 219 includes a weight element (not visible) along the front side 204 and is positioned over the chest and upper portion of the stomach of the infant. An attachment mechanism 114*a* for attaching to a bassinet, platform, or other location extend from the sides of the body 102 of the swaddle garment 100.

In an embodiment, sleep garment 100 may be configured to accommodate a pillow, gel pad or other type of support beneath the head or back of an infant. In an embodiment, enclosure 200 may be configured to accommodate a pillow, gel pad or other type of support beneath the head or back of an infant. As introduced above, in another embodiment, the swaddle garment 100 may incorporate the first accommodation mechanism 213 and/or the second accommodation mechanism 219. For example, the front side 104 may include the second accommodation mechanism 219 including or configured to associate with a weight element and/or the back side may include a first accommodation mechanism 213 including or configured to associate with a support element 215.

Figure 17:
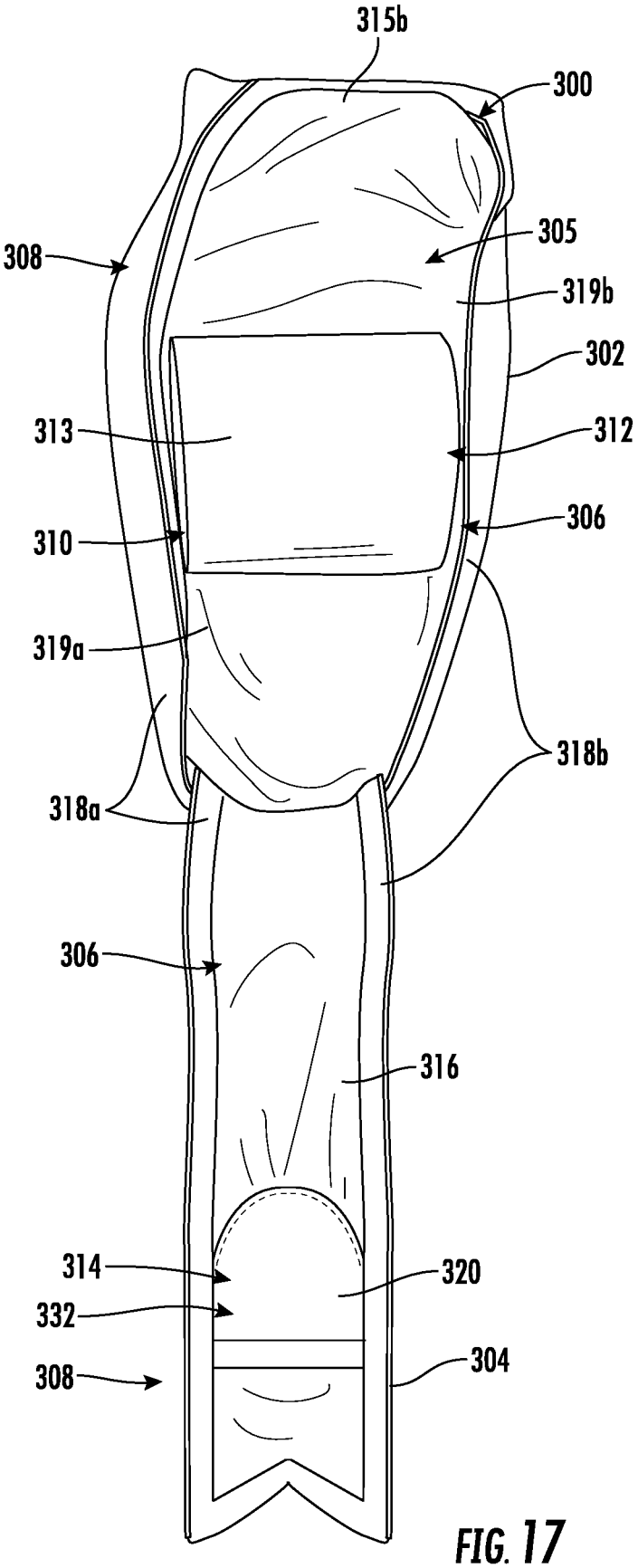
FIG. 17 illustrates the enclosure of FIG. 15 in an open position according to various embodiments described herein.

FIGS. 15-18B illustrate another enclosure 300 configuration according to various embodiments. The enclosure 300 includes a body having a front side 304 (FIG. 15) and a back side 302 (FIG. 16) that together define an enclosure space 305 (FIG. 17) between their respective interior surfaces. FIG. 17 illustrates the front side 302 partially separated or detached from the second side 304. The front and back sides 302, 304 may remain attached along a portion of their respective perimeters, as shown, or along another perimeter portion or may be completely separable (not shown). The enclosure space 305 includes a first portion 308 configured to accommodate a torso of an infant between the front side 304 and the back side 302. The enclosure space 305 also includes a second portion 306 configured to accommodate the lower body of an infant between the front side 304 and the back side 302.

The enclosure 300 may include one or more areas comprising mesh fabric 316 to provide breathability and reduce overheating. For example, the front side 304, the back side 302, or both may include one or more areas comprising a mesh fabric 316. In the illustrated embodiment, the front side 304 includes an area comprising a mesh fabric 316 along the second portion 306 defining a region of the enclosure space 305 corresponding to a region for enclosing the legs of an infant. The back side 302 also includes one or more areas of fabric mesh 316 along the first portion 308 defining a region of the enclosure space 305 corresponding to regions for enclosing arms or shoulders of an infant. In an embodiment, at least a surface of the enclosure 300 proximate to the second portion 306 may be comprised entirely of a breathable mesh structure. In a further embodiment, a majority of the enclosure 300 may comprise a breathable mesh material.

The enclosure 300 may be configured to include or associate one or more accommodation mechanisms. The accommodation mechanisms may be similar to the accommodation mechanisms described above with respect to FIGS. 10-14 and elsewhere herein. In the illustrated embodiment, the front side 304 is configured to couple with a weight element 332 and the back side 302 is configured to couple with a support element 312. For example, the enclosure 300 is configured to include or associate with an accommodation mechanism 319 comprising a weight element 332 and an accommodation mechanism 310 comprising a support element 312. In the illustrated embodiment, the enclosure 300 is configured to receive a weight element 332 at a location 335, proximate to the first portion 308 at the front side 304. The weight element 332 may be positioned such that it applies weight to the upper body, chest, and/or abdominal area of an infant enclosed in the enclosure 300. In the illustrated embodiment, as best shown in FIG. 17, a compartment 320 comprising a pocket is positioned on the front side 304 for receiving the weight element 332. The compartment 320 is accessible from the interior side of the front side 304. In one embodiment, the front side 304 includes a compartment 320 accessible from its exterior side or that is sewn, adhered, or otherwise closed, with the weight element 332 enclosed therein. In some embodiments, the front side 304 is configured to removably couple with the weight element via snaps, straps, clips, hook and loop, mating structures, or other attachment structures.

In various embodiments, the weight element 332 may weigh between 1 ounce and 3 pounds, preferably between 0.5 and 1.5 pounds, between 1 and 1.5 pounds, or about 5 pounds, about 0.75 pounds, about 1 pound, about 1.25 pounds, or about 1.5 pounds, or about 1.75 pounds. By positioning the weight element 332 at location 335, which corresponds to an upper body location proximate a chest of an infant, the pressure applied by the weight element 332 may be applied to a chest or abdominal area and elicit a calming response from the infant, aiding in the sleep of the infant. Further, upon being received at location 335, the weight element 332 may be fixed relative to an infant within the enclosure 300, and may be prevented from interfering with the sleep of the infant. In an embodiment, the pressure applied by weight element 332 upon being received at location 335 may be distributed over the chest and stomach of the infant. In an embodiment, the pressure from the weight element 332 may be at least partially distributed over the lower body of the infant as well. In an embodiment, the weight element 332 may be received at an alternate location to thereby distribute a portion of its weight over the upper body and a portion of the weight over the lower body of an infant enclosed in the enclosure 300.

In some embodiments, the weight element 332 may comprise any weighted material, which may include but is not limited to a metal, a plastic, a ceramic, a polymer, gel, liquid, a composite, a natural, or an artificial material. Furthermore, the weight element 332 may be flat, round, irregular or any other shape and further may be any size so as to be effective for its functions described herein.

As introduced above, enclosure 300 also includes an accommodation mechanism 310 comprising or configured to receive a support element 312. The support element 312 may extend within the enclosure space 305 and include a structure dimensioned to elevate the lower body, legs, and/or feet of an infant, e.g., from between 0 and 8 inches, such as between 3 and 6 inches, between 4 or 4.5 and 5.5 inches, at least or greater than 4 inches, or approximately 5 inches +/−¼ inch. The support element 312 may extend from the interior side of the back side 302 so as to underlay the legs of an infant when enclosed in the enclosure space 305. The support element 312 may include an upper surface 313 positioned to underlay the lower body, legs, and/or feet of the infant and that extends a distance from the back side 302 corresponding to the elevation distance the support element 312 is configured to elevate the lower body, legs, and/or feet. The elevation and operable perimeter surface for contacting an infant's lower body, legs, and/or feet is preferably sufficient to produce a bend in the hips and elevate the feet of the infant. The support element 312 may be configured to support the infant's legs at an elevated angle relative to the infant's hips. In some instances, the hips may also contact the support element 312 or otherwise be elevated.

The support element 312 may include various dimensions and cross-section shapes. The illustrated support element 312 includes a generally cylindrical shape having an arcuate cross-section that extends outwardly from the back side 302. In one embodiment, the support element 312 includes a planar exterior facing surface, an arcuate interior facing surface, and comprises a general "D" shaped cross-section. In another embodiment, the support element 312 is arcuate around its entire or a majority of its cross-section perimeter. In other embodiments, the support element 312 comprises other dimensions and cross-section shapes. For example, the support element 312 may comprise geometric, non-geometric, or free form cross-section shapes. In some embodiments, the support element 312 includes inclined, declined, curved, planar, or undulating surfaces. In one embodiment, the top surface 313 comprises an edge formed by the convergence of two sides that form a peak along a length of the support element 312. In one configuration, the support element 312 is dimensioned and shaped as described above with respect to support element 215. In some embodiments, the support element 312 may include but is not limited to a foam material, a cushion, an air pocket, or any material configured to support an infant's legs in an elevated angle relative to the infant's torso. In the illustrated embodiment, the support element 312 comprises a generally cylindrical foam insert approximately 5 inches in elevation configured to produce bend in hips and elevate feet of an infant. The support element 312 may further comprise a fabric case (not shown) surrounding the supportive material. The support element 312 may have a resistance to deformation configured to support the infant's legs in the elevated position according to the principles disclosed herein. In various embodiments, the support element 312 may include contours such as indentations to nest the legs. For example, a top surface, distal facing surface, and/or proximal facing surface of the support element 312 may include a first indentation to nest a first leg and a second indentation to nest a second leg. Thus, the surfaces within and/or adjacent to the indentations may rise above a back of a leg. In some embodiments, the surfaces within and/or adjacent to the indentations may contact sides of a leg or provide vertically extending obstructions to lateral leg movement. The indentations may be of a constant width or may tapper to a reduced width within indentation valleys. The indentations may have planar bases or may include rounded or arcuate laterally extending base surfaces. The support element 312 and/or a fabric case may also be resistant to liquid or biological materials. It will be appreciated that height of the support element 312 or vertical distance the support element 312 extends as described herein is intended to be in reference to the top surface upon which the back or legs or feet are supported.

The support element 312 may be integral or couplable with respect to the back side 302. For example, the enclosure 300 may be configured to receive the support element 312 at a location proximate to the second portion 306 along the back side 302. The support element 312 may be positioned along the second portion 306 such that it elevates the lower body, legs, and/or feet and produces a bend in the hips of an infant enclosed in the enclosure 300. In the illustrated embodiment, as best shown in FIG. 17, a compartment 322 comprising a pocket is position on the back side 302 for receiving the support element 312. Thus, the support element 312 may comprise a material insert. The pocket may comprise an envelope enclosure configuration as shown or another configuration. The compartment 322 is accessible from the exterior side of the back side 302. In one embodiment, the back side 302 includes a compartment 322 accessible from its interior side or that is sewn, adhered, or otherwise sealed closed with the support element 312 enclosed therein. In some embodiments, the back side 302 is configured to removably couple with the support element 312 via snaps, straps, clips, Velcro or hook and loop, mating structures, or other coupling structures along the exterior or interior side of the back side 302.

Figure 15:
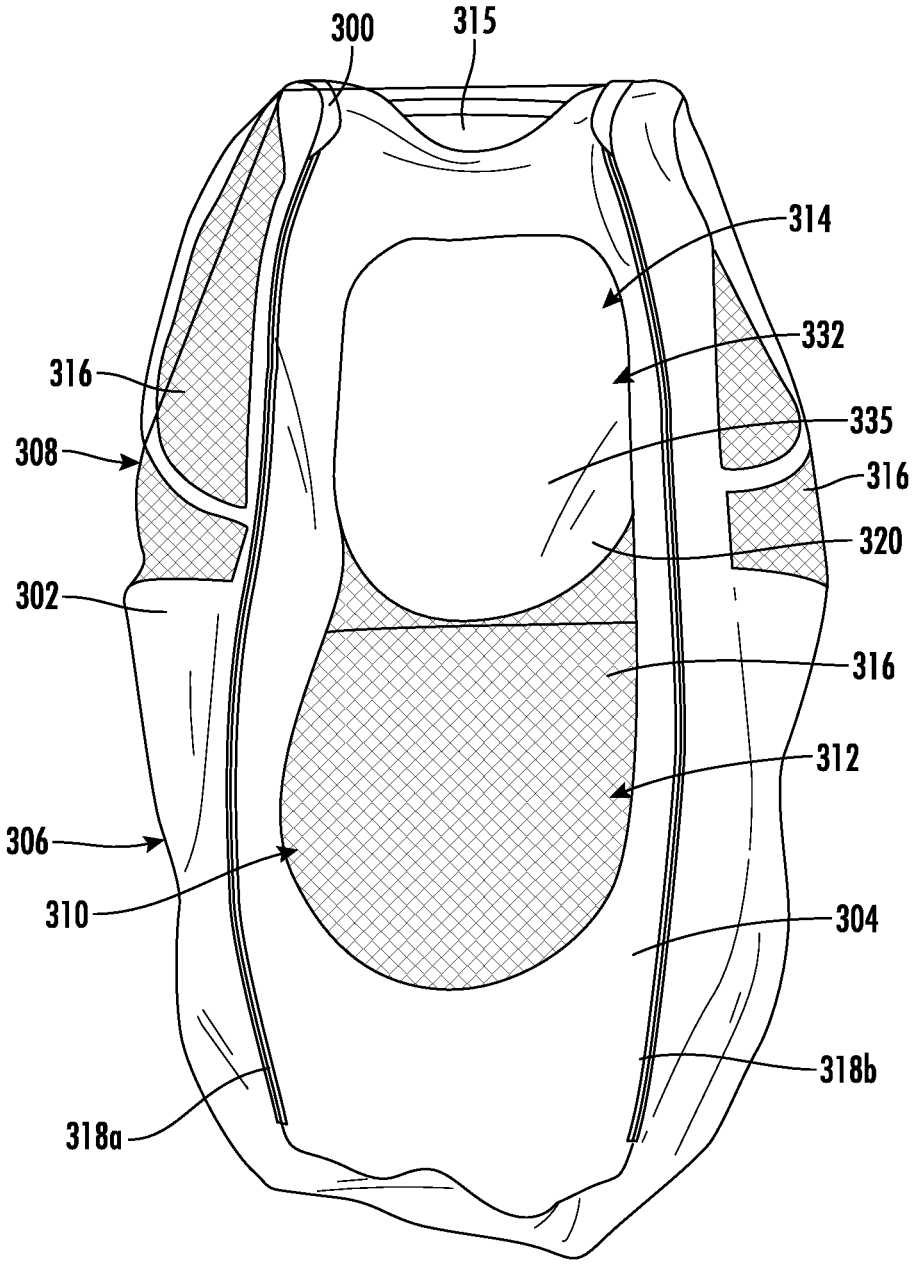
FIG. 15 illustrates an enclosure in an enclosed position according to various embodiments described herein.
Figure 16:
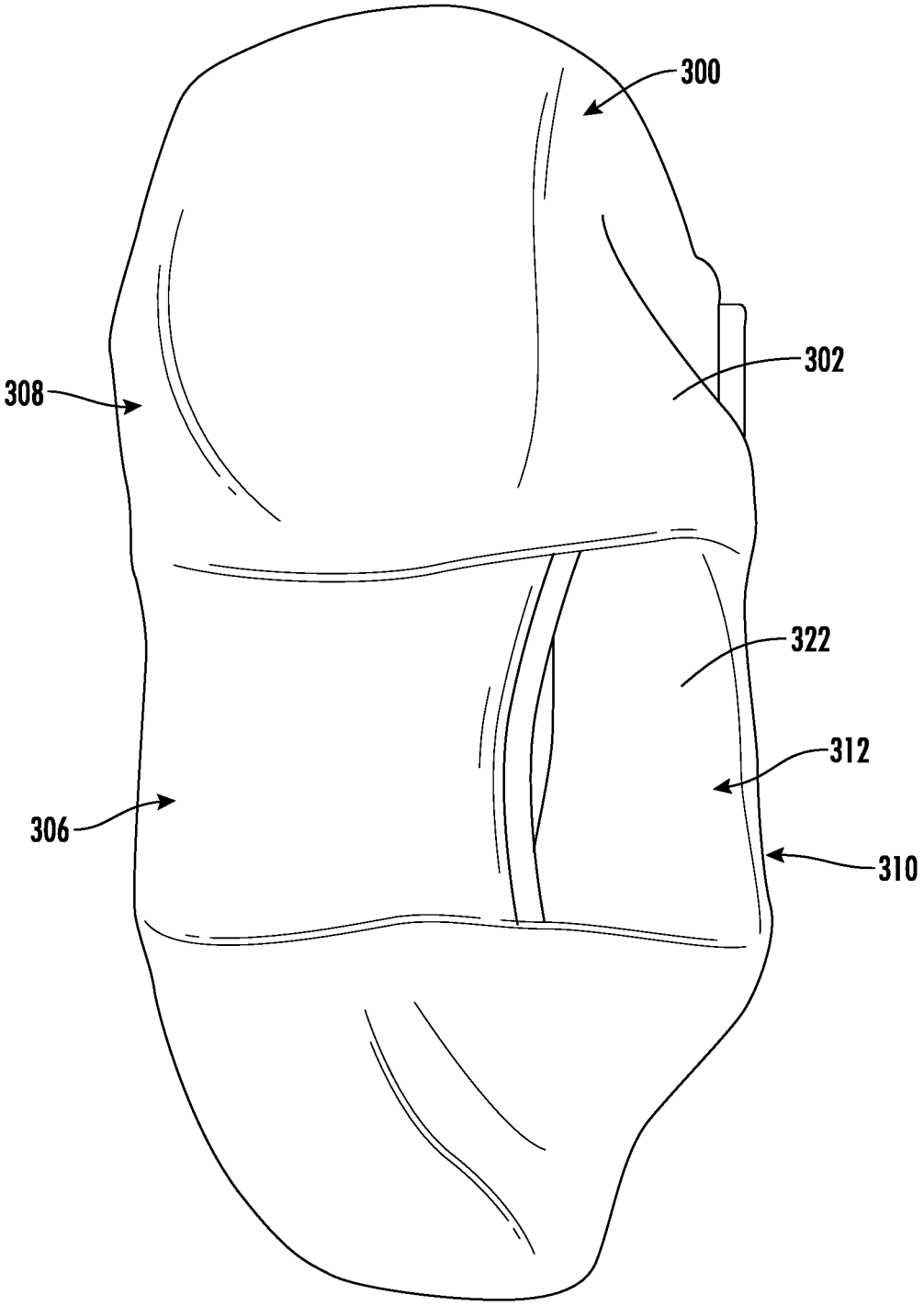
FIG. 16 illustrates a back side view of the enclosure of FIG. 15 according to various embodiments described herein.

The enclosure 300 may also define one or more selectively openable apertures between the exterior or the enclosure and the enclosure space 305. In the illustrated embodiment, the enclosure 300 includes a coupling mechanism comprising one or more attachment devices 318*a*, 318*b* for coupling the front side 304 and the back side 302 and thereby selectively open or close first and second apertures 319*a*, 319*b*. The selectively openable apertures are located along lateral peripheries of the front and back sides 304, 302. Attachment devices 318*a*, 318*b* extend along the adjacent lateral peripheries for coupling the front and back sides 304, 302 to close or reveal the enclosure space 305. As best shown in FIGS. 15 & 17, the attachment devices 318*a*, 318*b* comprise zippers wherein adjacent portions of the front and back sides 304, 302 defining the apertures 319*a*, 319*b* include zipper halves. In other embodiments, adjacent portions of the front and back sides 304, 302 defining one or more apertures may include snaps, straps, clips, hook and loop, mating structures, or other attachment structures configured to interact to selectively reveal the enclosure space 305.

In other embodiments, the front side 304 couples to the back side 302 via closure of a single aperture. For example, a selectively openable and closable aperture may extend down a right, left, or middle portion of the front and/or backsides 304, 302. In a further example, a selectively openable and closable aperture extends diagonally across the front and/or back sides 304, 302. Some embodiments of the enclosure 300 may include more than two selectively openable or closable apertures.

An infant may be placed within the enclosure 300, with the infant's hips adjacent to support element 312 and legs positioned on upper surface 313 thereof. A user may then operate attachment devices 318*a*, 318*b* to close the apertures 319*a*, 319*b*. The illustrated apertures 319*a*, 319*b* extend through the second portion 306 and the first portion 308 to a bottom region or location corresponding to a region of the enclosure space 305 configured to be at or beyond the feet of an enclosed infant. In other embodiments, one or more apertures may not be dimensioned to extend beyond a foot region of the enclosure space 305. For example, an aperture may extend to an ankle or knee region of the enclosure space 305. In some embodiments, the enclosure 300 may include multiple selectively openable and closable apertures wherein a length of a first aperture is less than a length of a second aperture. Decoupling attachment devices 318*a*, 318*b* allows the front side 304 to be pulled down and moved out of the way to reveal the enclosure space 305. This configuration provides caregivers significant visibility for proper positioning of an infant and ease of removal. In another embodiment, the front side 304 and back side 302 may be completely separated to reveal the enclosure space 305 and may thereafter be coupled with attachment members as described herein.

Enclosure 300 further defines a neck opening 315 (FIG. 15) between the front and backsides 304, 302. The front side 304 includes a first portion 315*a* defining a first side of the neck opening 315 and the back side 302 includes a second portion 315*b* defining a second side of the neck opening 315. When the attachment devices 318*a*, 318*b* are coupled to close the apertures 319*a*, 319*b*, the first portion 315*a* and the second portion 315*b* define the neck opening to allow a neck of an infant to extend from the enclosure space 305.

Figure 18A:
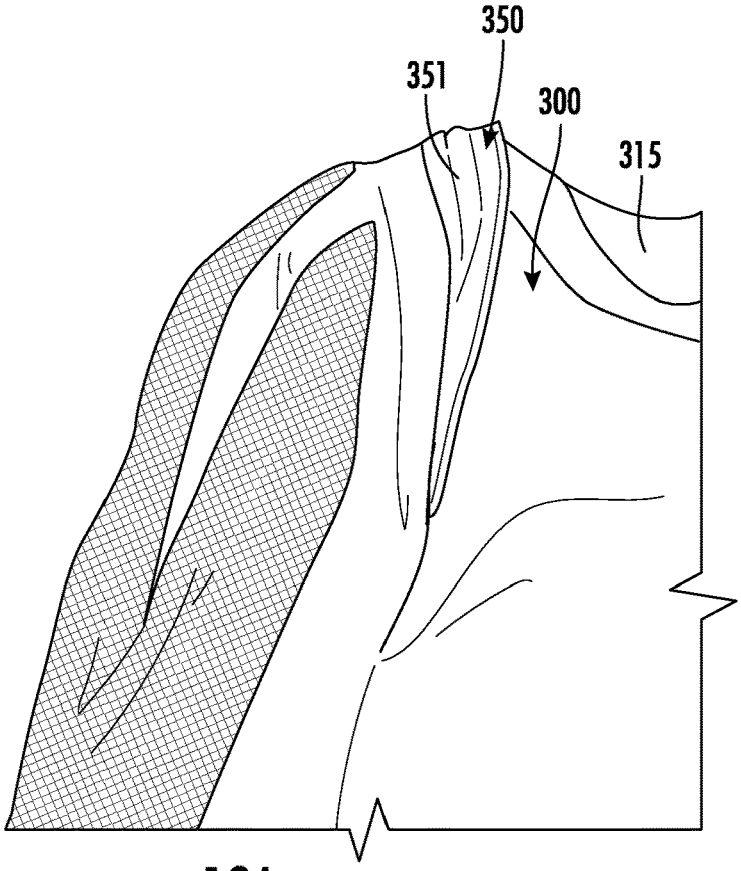
FIGS. 18A & 18B illustrate a zipper garage feature according to various embodiments described herein.
Figure 18B:
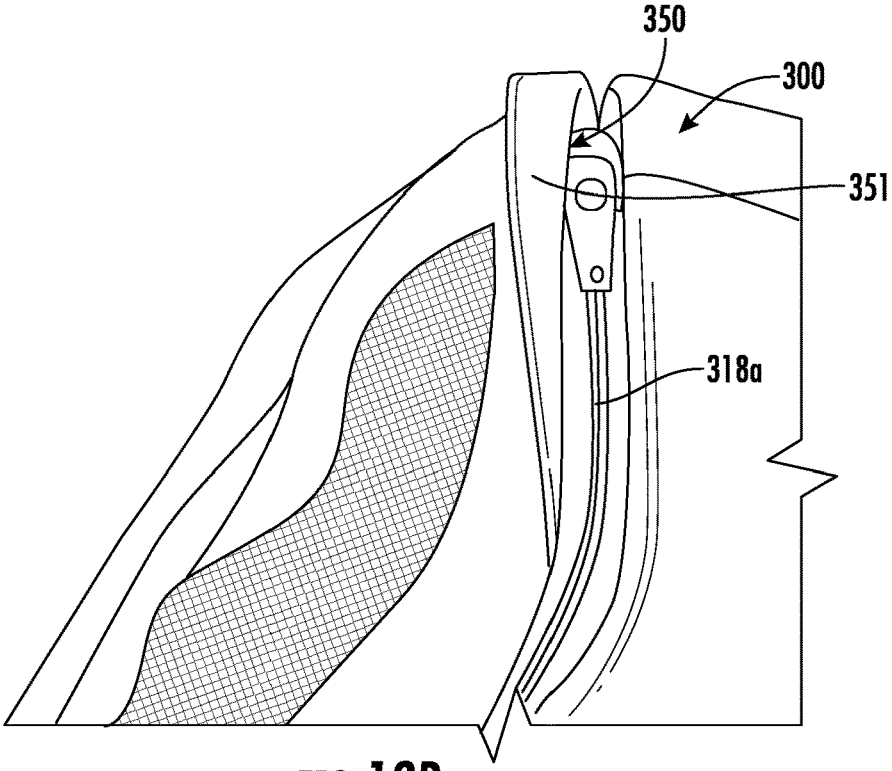

To better protect sensitive skin of an infant, all or a portion of one or more attachment devices 318*a*, 318*b* may be covered with interiorly, exteriorly, or both with a separating material. FIGS. 18A & 18B illustrate an embodiment of the enclosure 300 wherein a portion of the attachment device 318*a* is covered by a zipper garage 350 comprising a flap 351 configured to extend exteriorly, over the attachment device 318*a* along a portion thereof corresponding to the neck opening 315 and an adjacent region. In various embodiments, the flap 351 may include a reinforcement or biasing material configured to cover the attachment device 318*a* or portion thereof when coupled. In one embodiment, the flap 351 includes a magnet or magnetically attractive structure to attract to the attachment device 318*a* or a magnet or magnetically attractive structure adjacent to the attachment device 318*a*. In another example, the flap 351 may include an exteriorly facing attachment device such as a snap configured to mate with an adjacent interiorly facing snap to cover the attachment device 318*a*. While the zipper garage 350 is shown with respect to attachment device 318*a*, in some embodiments, a zipper garage is provided for attachment device 318*b* in addition to or instead of for attachment device 318*a*. In some embodiments, enclosure 300 does not include a zipper garage 350.

The enclosure 300 may include additional features. For example, in an embodiment, enclosure 300 may be configured to accommodate a pillow, gel pad or other type of support (not shown) beneath the head of an infant. In one embodiment, the enclosure includes a harness for securing an infant within the body of the enclosure 300, such as a harness described herein attached to the interior side of the back side 302 of the enclosure 300.

Figure 19:
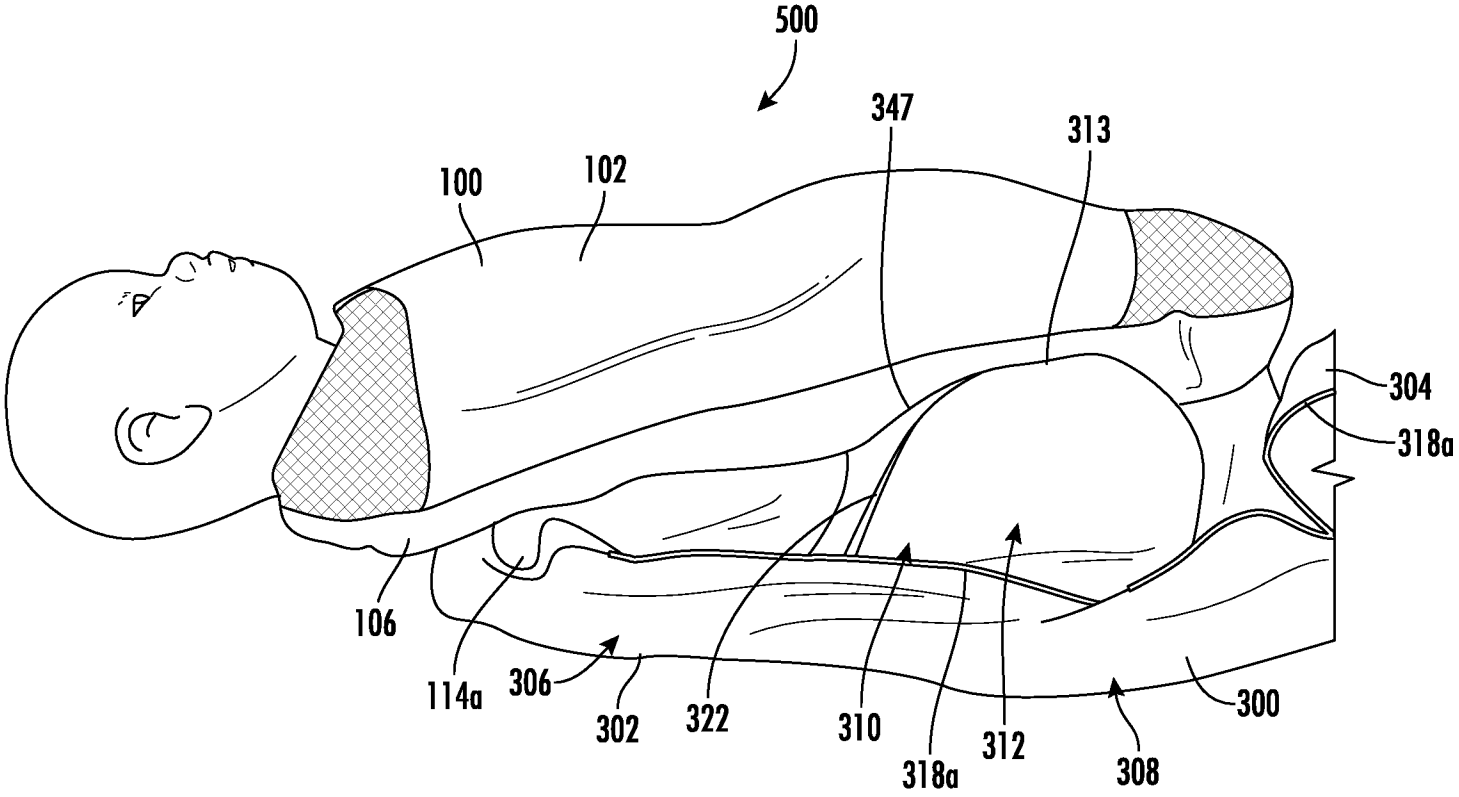
FIG. 19 illustrates a swaddle system according to various embodiments described herein.
Figure 20A:
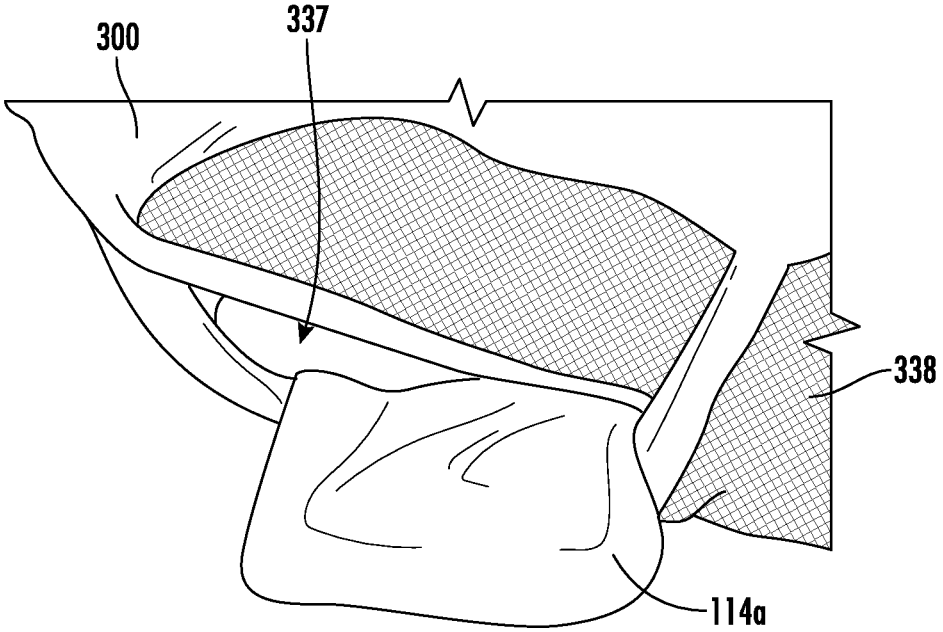
FIGS. 20A & 20B illustrate a garment opening for extending an attachment mechanism from an enclosure space of a sleep garment and a pocket for tucking away the attachment mechanism when not in use according to various embodiments described herein.
Figure 20B:
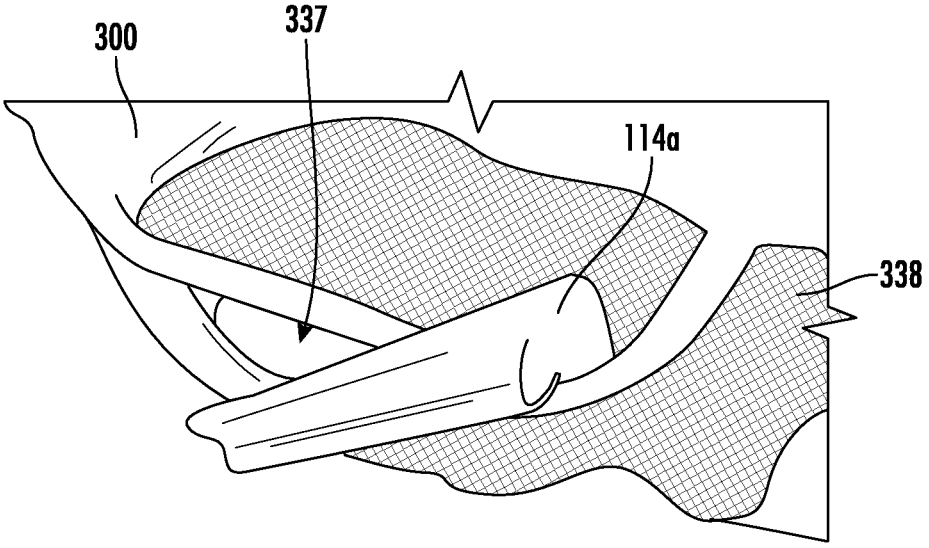
Figure 21:
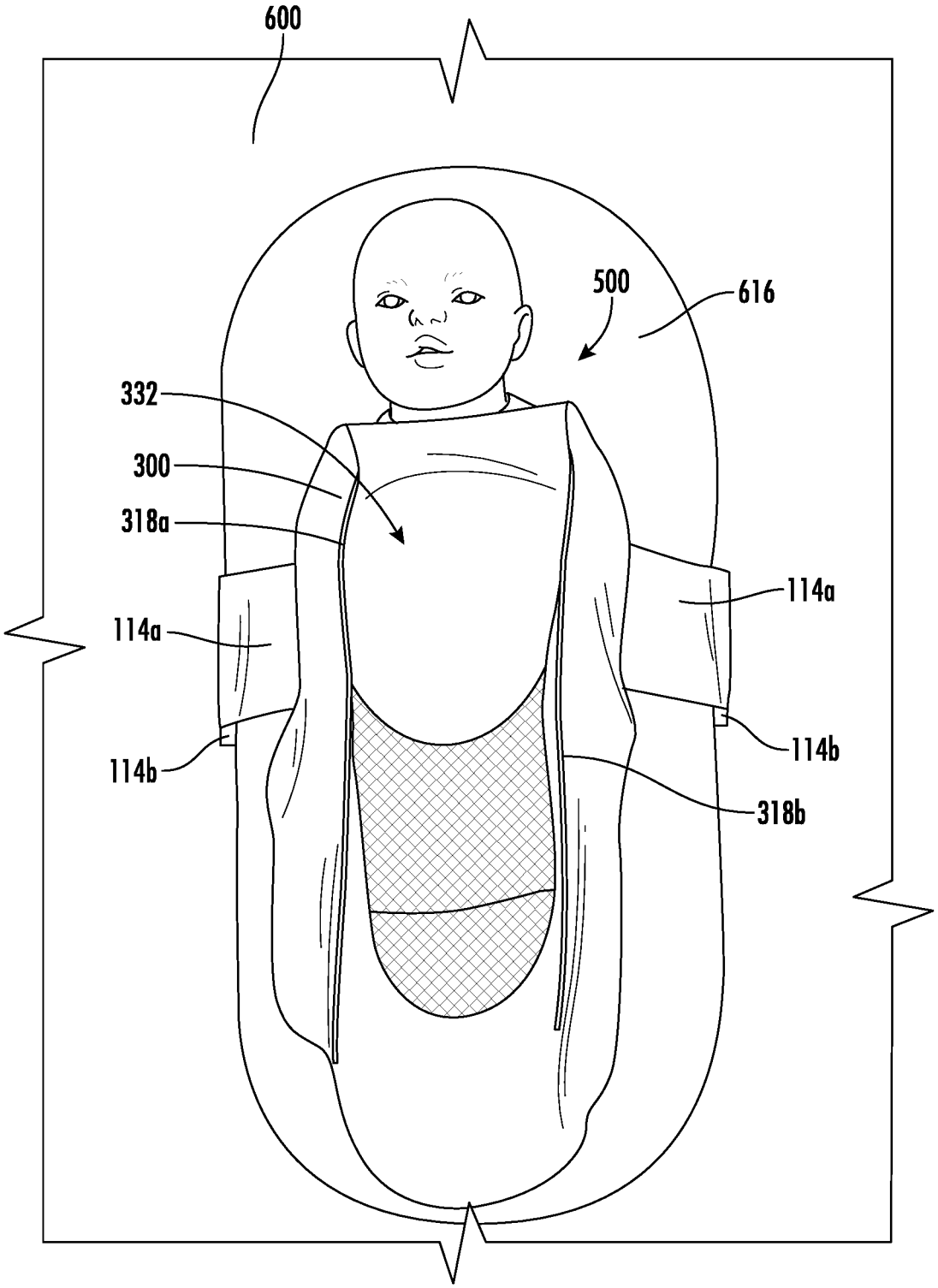
FIG. 21 illustrates the swaddle system including a swaddle garment enclosed by an enclosure, wherein the enclosure and infant are indirectly secured to a platform of a sleep device according to various embodiments described herein.

FIGS. 19-21 illustrates a swaddle system 500 comprising an enclosure 300 as described above with respect to FIGS. 15-16 and a swaddle garment 100 comprising a harness (not visible) as described with respect to FIGS. 9A-9D. However, other swaddle garment configurations may similarly be used, such as any of those described herein, e.g., a swaddle garment described with respect to FIGS. 1-3F and FIGS. 8A-8E.

An infant may be harnessed and enclosed within the swaddle garment 100, as described above. With particular reference to FIG. 19, the back side 102 of the swaddle garment 100 may be positioned along the back side 302 of the enclosure 300 such that the lower body of the infant up against the support element 312 and the lower legs, ankles, and/or feet of the infant extending over the top surface 313. In some examples, thighs may be over the top surface 313 or the infant may be placed with feet up against the support element 312. From the side view shown in FIG. 19, the hips and feet of the infant are elevated up onto the support element 312 and top surface 313 thereof. The buttocks or thighs of the infant may contact a proximal surface 347 of the support element 312.

With further reference to FIG. 21, to enclose the swaddle garment 100 within the enclosure 300, the front side 304 may be pulled over the infant with the weight element 332 positioned over the chest/abdomen region of the infant and the attachment devices 318*a*, 318*b* operated to couple the front side 304 and back side 302.

With further reference to FIGS. 20A & 20B, if the securing mechanism 114*a* is desired to be available for use, the securing mechanism 114*a* or portion thereof may be extended out from the enclosure space 305 through laterally positioned side openings 337 formed in the enclosure 300. The enclosure 300 may also include a pocket 338 adjacent to opening 337 for tucking in the securing mechanism 114*a* or portion thereof when not in use.

It is noted, that in some embodiments the enclosure 300 does not include side openings 337 or includes side openings 337 with attachment members (not shown) to selectively open and close the openings 337. In one embodiment, the enclosure 300 includes securing mechanisms similar to that described herein with respect to sleep sacks or bodies thereof for securing the enclosure 300 to a platform or bassinet. The securing mechanism may be in addition to or instead of securing mechanism 114*a*. In one such embodiment, the enclosure 300 includes a pocket (not shown) for tucking the securing mechanism out of the way when not in use.

With particular reference again to FIG. 21, the enclosure 300 may couple to a sleep platform 616 of a sleep device, which is a bassinet 600 in the illustrated embodiment. The attachment mechanism 114*a* may attach to corresponding attachment mechanisms 114*b* associated with the bassinet 600 in a manner described above with respect to FIGS. 4 & 5. Other attachment mechanisms may be used, such as those described elsewhere herein. In various embodiments, attachment mechanisms 114*a* and corresponding attachment mechanisms 114*b* may correspond to attachment mechanisms described in U.S. patent application Ser. No. 15/336,519, filed Oct. 27, 2016, titled Infant Calm/Sleep-Aid, SIDS Prevention Device, and Method of Use. In one embodiment, the sleep device comprises a sleep device or bassinet having a movable platform as described in U.S. patent application Ser. No. 15/336,519, filed Oct. 27, 2016, titled Infant Calm/Sleep-Aid, SIDS Prevention Device, and Method of Use. By attaching the enclosure 300 to a sleep platform 616, the infant harnessed and swaddled in the swaddle garment 100 and further accommodated within enclosure 300 may be prevented from rolling over or otherwise moving into an unsafe disposition.

In various embodiments, a sleep system includes a sleep device, such as a bassinet 600, having a movable platform as described herein, e.g., as described with respect to FIG. 4. The sleep system may further include a swaddle garment 100 and harness 140 as described herein, e.g., as described with respect to FIGS. 9A-9D. The system may include an attachment mechanism 114 comprising an attachment mechanism 114*a* associated with the swaddle garment 100 and an attachment mechanism 114*b* associated with a movable platform 616 of the sleep device (see, e.g., FIGS. 4 & 5) for securely attaching the swaddle garment 100 to the sleep device. In some embodiments, the sleep system may include an enclosure 200, 300 (see, e.g., FIGS. 10-21) including one or more accommodation mechanisms.

This specification has been written with reference to various non-limiting and non-exhaustive embodiments. However, it will be recognized by persons having ordinary skill in the art that various substitutions, modifications, or combinations of any of the disclosed embodiments (or portions thereof) may be made within the scope of this specification. Thus, it is contemplated and understood that this specification supports additional embodiments not expressly set forth in this specification. Such embodiments may be obtained, for example, by combining, modifying, or re-organizing any of the disclosed steps, components, elements, features, aspects, characteristics, limitations, and the like, of the various non-limiting and non-exhaustive embodiments described in this specification.

It will be appreciated that spatial terms may be used herein with respect to the described embodiments. It is to be appreciated that such spatial terms are generally used to describe spatial location of features relative to other features are not intended to be limiting. To assist the reader in understanding the present description, certain features are described using familiar language for convenience and clarity. For example, spatial terms such as top, bottom, lower, upper, side, underside, upper side, back side, etc. are used herein with respect to the illustrations and operation of the embodiments.

Various elements described herein have been described as alternatives or alternative combinations, e.g., in a lists of selectable actives, ingredients, or compositions. It is to be appreciated that embodiments may include one, more, or all of any such elements. Thus, this description includes embodiments of all such elements independently and embodiments including such elements in all combinations.

The grammatical articles "one", "a", "an", and "the", as used in this specification, are intended to include "at least one" or "one or more", unless otherwise indicated. Thus, the articles are used in this specification to refer to one or more than one (i.e., to "at least one") of the grammatical objects of the article. By way of example, "a component" means one or more components, and thus, possibly, more than one component is contemplated and may be employed or used in an application of the described embodiments. Further, the use of a singular noun includes the plural, and the use of a plural noun includes the singular, unless the context of the usage requires otherwise. Additionally, the grammatical conjunctions "and" and "or" are used herein according to accepted usage. By way of example, "x and y" refers to "x" and "y". On the other hand, "x or y" refers to "x", "y", or both "x" and "y", whereas "either x or y" refers to exclusivity.

Any numerical range recited herein includes all values and ranges from the lower value to the upper value. For example, if a range is stated as 1 to 50, it is intended that values such as 2 to 40, 10 to 30, 1 to 3, or 2, 25, 39 and the like, are expressly enumerated in this specification. These are only examples of what is specifically intended, and all possible combinations of numerical values and ranges between and including the lowest value and the highest value enumerated are to be considered to be expressly stated in this application. Numbers modified by the term "approximately" are intended to include +/−10% of the number modified.

The present disclosure may be embodied in other forms without departing from the spirit or essential attributes thereof and, accordingly, reference should be had to the following claims rather than the foregoing specification as indicating the scope of the invention. Further, the illustrations of arrangements described herein are intended to provide a general understanding of the various embodiments, and they are not intended to serve as a complete description. Many other arrangements will be apparent to those of skill in the art upon reviewing the above description. Other arrangements may be utilized and derived therefrom, such that logical substitutions and changes may be made without departing from the scope of this disclosure.

What is claimed is:

1. A swaddle garment comprising:

a body having a back side and a front side that together define an interior space for swaddling an infant, wherein the front side includes a first side and a second side that are selectively couplable to enclose the interior space; and a harness attached or attachable within the interior space along the backside of the body of the swaddle garment, the harness comprising:

a back side positioned along a portion of the back side of the body, a torso wrap to wrap around a torso of an infant, the torso wrap comprising a first side and a second side extendable from the back side of the harness, wherein the torso wrap has a vertical length that extends between a lower extent and an upper extent when wrapped around the torso of the infant, and wherein an attachment structure along an underside of the first side of the torso wrap couples to a corresponding attachment structure along an upper side of the second side of the torso wrap to couple the first side to the second side of the torso wrap, and a diaper flap to wrap around a crotch of the infant, the diaper flap extendable from the back side of the harness from an anchor end to a securing end, wherein, when the diaper flap is secured to the torso wrap, an attachment structure along an underside of the securing end of the diaper flap couples to attachment structures along upper sides of the coupled first side and second side of the torso wrap such that the securing end of the diaper flap attaches to both the first side and the second side of the torso wrap.

2. The swaddle garment of claim 1, wherein the first side of the torso wrap includes an attachment structure and the second side of the torso wrap includes an attachment structure, wherein the attachment structures of the first and second sides of the torso wrap are selectably couplable to selectively couple and uncouple the first and second sides of the torso wrap.

3. The swaddle garment of claim 1, wherein the securing end of the diaper flap has a horizontal width wider than a horizontal width of a midsection of the diaper flap.

4. The swaddle garment of claim 1, wherein the anchor end and the securing end have horizontal widths greater that a horizontal width of a midsection of the diaper flap.

5. The swaddle garment of claim 1, wherein the diaper flap includes an adjustable operable length to accommodate multiple crotch lengths.

6. The swaddle garment of claim 5, wherein one or both of the first side or second side of the torso wrap includes an attachment structure having multiple locations along the vertically extending length of the torso wrap for selectively coupling to the securing end of the diaper flap to adjust the operable length of the diaper flap when the securing end of the diaper flap is coupled to the attachment structure.

7. The swaddle garment of claim 1, wherein upper surfaces of both the first side and second side of the torso wrap include attachment structures for coupling to an attachment structure at the securing end of the diaper flap.

8. The swaddle garment of claim 1, wherein the attachment structures along the undersides of the first side of the torso wrap and the securing end couple to the attachment structure along the upper side of the second side of the torso wrap.

9. The swaddle garment of claim 1, wherein the torso wrap includes an adjustable girth.

10. The swaddle garment of claim 1, wherein the back side of the body of the swaddle garment includes the back side of the harness.

11. The swaddle garment of claim 1, wherein the back side of the harness is removably attachable to the back side of the body of the swaddle garment via hook and loop, snaps, or clips.

12. The swaddle garment of claim 1, wherein the first side of the torso wrap, second side of the torso wrap, diaper flap, or combination thereof directly attach to the back side of the body of the swaddle garment, and wherein the back side of the body of the swaddle garment includes the back side of the harness.

13. The swaddle garment of claim 1, further comprising an attachment mechanism for selectively attaching the swaddle garment to a movable platform of a sleep device.

14. A sleep system, the system comprising:

a sleep device comprising a movable platform and an attachment mechanism; and a swaddle garment comprising:

a body having a first side and a back side and a front side that together define an interior space for swaddling an infant, wherein the front side includes a first side and a second side that are selectively couplable to enclose the interior space, an attachment mechanism for selectively coupling to the attachment mechanism of the sleep device to secure and release the swaddle garment with respect to the movable platform, and a harness attached or attachable within the interior space along the backside of the body of the swaddle garment, the harness comprising:

a back side positioned along a portion of the back side of the body, a torso wrap to wrap around a torso of an infant, the torso wrap comprising a first side and a second side extendable from the back side of the harness, wherein the torso wrap has a vertical length that extends between a lower extent and an upper extent when wrapped around the torso of the infant, and wherein an attachment structure along an underside of the first side of the torso wrap couples to a corresponding attachment structure along an upper side of the second side of the torso wrap to couple the first side to the second side of the torso wrap, and a diaper flap to wrap around a crotch of the infant, the diaper flap extendable from the back side of the harness from an anchor end to a securing end, wherein, when the diaper flap is secured to the torso wrap, an attachment structure along an underside of the securing end of the diaper flap couples to attachment structures along upper sides of the coupled first side and second side of the torso wrap such that the securing end of the diaper flap attaches to both the first side and the second side of the torso wrap.

15. The swaddle garment of claim 1, wherein the torso wrap is configured to wrap around the torso and arms of the infant to secure the arms of the infant at sides of the infant, and wherein the upper extent of the torso wrap is configured to position over the infant above elbows but below shoulders of the infant when the torso wrap is wrapped around the torso and arms of the infant and the diaper flap is wrapped around the crotch of the infant.

16. The swaddle garment of claim 15, wherein the lower extent of the torso wrap is configured to position below wrists of the infant when the torso wrap is wrapped around the torso and arms of the infant and the diaper flap is wrapped around the crotch of the infant.

17. The swaddle garment of claim 16, wherein the upper extent of the torso wrap is configured to position below armpits of the infant when the torso wrap is wrapped around the torso and arms of the infant and the diaper flap is wrapped around the crotch of the infant.

18. The system of claim 14, wherein the torso wrap is configured to wrap around the torso and arms of the infant to secure the arms of the infant at sides of the infant, and wherein the upper extent of the torso wrap is configured to position over the infant above elbows but below shoulders of the infant when the torso wrap is wrapped around the torso and arms of the infant and the diaper flap is wrapped around the crotch of the infant.

19. The system of claim 18, wherein the lower extent of the torso wrap is configured to position below wrists of the infant when the torso wrap is wrapped around the torso and arms of the infant and the diaper flap is wrapped around the crotch of the infant.

20. The system of claim 19, wherein the upper extent is configured to position below armpits of the infant when the torso wrap is wrapped around the torso and arms of the infant and the diaper flap is wrapped around the crotch of the infant.

* * * * *